US006428371B1

(12) United States Patent
Michel et al.

(10) Patent No.: US 6,428,371 B1
(45) Date of Patent: Aug. 6, 2002

(54) WATERCRAFT WITH STEER RESPONSIVE ENGINE SPEED CONTROLLER

(75) Inventors: Camille Michel, Ste-Foy; Alain Rheault, Longueuil, both of (CA)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 09/961,387

(22) Filed: Sep. 25, 2001

Related U.S. Application Data

(63) Continuation of application No. 09/383,073, filed on Aug. 26, 1999, now Pat. No. 6,336,833, which is a continuation-in-part of application No. 08/782,490, filed on Jan. 10, 1997, now abandoned.

(51) Int. Cl.[7] ..... B63H 25/00

(52) U.S. Cl. ..... 440/38; 114/144 R; 440/40; 440/84; 440/87

(58) Field of Search ..... 114/144 R; 440/1, 440/2, 38, 40, 42, 84, 85, 86, 87, 900

(56) References Cited

U.S. PATENT DOCUMENTS

| | | | |
|---|---|---|---|
| 3,183,879 | A | 5/1965 | Heidner |
| 3,874,321 | A | 4/1975 | Smith |
| 3,976,026 | A | 8/1976 | Eastling |
| 4,230,646 | A | 10/1980 | Ghizzoni |
| 4,519,335 | A | 5/1985 | Krautkremer et al. |
| 4,693,689 | A | 9/1987 | Harada |
| 4,739,236 | A | 4/1988 | Burkenpas |
| 4,747,359 | A | 5/1988 | Ueno |
| 4,759,731 | A | 7/1988 | Uchida et al. |
| 4,767,363 | A | 8/1988 | Uchida et al. |
| 4,854,902 | A | 8/1989 | Havins |
| 4,962,717 | A | 10/1990 | Tsumiyama |
| 5,016,553 | A | 5/1991 | Spencer |
| 5,090,929 | A | 2/1992 | Rieben |
| 5,203,727 | A | 4/1993 | Fukui |
| 5,253,604 | A | 10/1993 | Bohlin |
| 5,256,092 | A | 10/1993 | Jones |
| 5,368,510 | A | 11/1994 | Richard |
| 5,389,016 | A | 2/1995 | Nestvall |
| 5,423,277 | A | 6/1995 | Gai |
| 5,538,449 | A | 7/1996 | Richard |
| 5,586,921 | A | 12/1996 | Kobayashi et al. |
| 6,159,059 | A | 12/2000 | Bernier et al. |
| 6,231,410 | B1 | 5/2001 | Bernier et al. |

FOREIGN PATENT DOCUMENTS

| | | |
|---|---|---|
| CA | 2207938 | 7/1998 |
| EP | 0 388 228 | 9/1990 |
| FR | 2687364 | 8/1993 |

OTHER PUBLICATIONS

Sea–Doo Jet Boats, Challenger 1800 5600/5601, Catalogue of Pieces, Parts Catalogue, (1997).

*Primary Examiner*—Stephen Avila
(74) *Attorney, Agent, or Firm*—Pillsbury Winthrop LLP

(57) ABSTRACT

A watercraft with a steer-responsive speed controller generates thrust when the steerable propulsion unit is turned beyond a predetermined angular threshold. Turning the steering wheel beyond the threshold causes the speed controller to increase engine speed so that the propulsion unit produces thrust at least equal to the minimal propulsive force needed to effectively steer the watercraft. This system ensures that there is always sufficient thrust for steering the watercraft. This system is applicable to single-engine personal watercraft, twin-engine jet boats or motorboats equipped with swivel-mounted outboard motors. In one form of the system, rotation of the steering wheel beyond the angular threshold causes an actuating cable to open the throttle to increase engine speed. Alternatively, an electronic control system regulates the engine by calculating the optimal power settings based on measurements derived from a speed sensor, a steering angle sensor and, optionally, a throttle position sensor.

73 Claims, 12 Drawing Sheets

WATERCRAFT WITH STEER RESPONSIVE ENGINE SPEED CONTROLLER

The present application claims priority to and is a continuation of U.S. application Ser. No. 09/383,073, filed Aug. 26, 1999, now U.S. Pat. No. 6,336,833 issued Jan. 8, 2002, which is a cip of application 08/782,490, filed Jan. 10, 1997, now abandoned the entirety of each of which are hereby incorporated into the present application by reference.

FIELD OF THE INVENTION

The present invention relates to watercraft with steerable propulsion units and, more particularly, to a steering system for such a watercraft.

BACKGROUND OF THE INVENTION

A watercraft equipped with a steerable propulsion unit can only be steered effectively when the propulsion unit is generating thrust. Examples of watercraft with a steerable propulsion unit are jet boats, personal watercraft, jet skis, and motorboats having swivel-mounted outboard motors. With any of these types of watercraft, the operator who releases the throttle loses the ability to effectively steer the watercraft. At low speeds, this typically makes docking difficult because it becomes necessary to open the throttle to maneuver the boat. Similarly, if the throttle is suddenly cut while running the watercraft at high speeds, the ability to steer can only be regained by reopening the throttle.

SUMMARY OF THE RELEVANT PRIOR ART

U.S. Pat. No. 3,183,379 (Heidner) discloses a speed control device for use primarily on an outboard motor. When a motorboat that is either at rest or traveling at low speed is steered sharply (i.e. beyond a predetermined angle), a limiting rod interferes with the rotation of a throttle control member thereby limiting the RPM of the motor. The throttle control has a cam with a lobe that catches the limiting rod when the limiting rod is pressed against the cam. This prevents the boat from capsizing when the throttle is suddenly advanced and the motor is already set for a sharp turn. Since the danger of capsizing is significantly less when the boat is already traveling above a predetermined speed, the speed control device allows the motor to be swiveled through a full extent without actuating the limiting rod and interfering with the throttle control member. The predetermined speed (or RPM) above which the throttle control member becomes unconstrained by the limiting rod corresponds to an angular position of the cam at which the leading edge of the lobe has been rotated at least slightly beyond the line of action of the limiting rod.

U.S. Pat. No. 4,230,646 (Ghizzoni) discloses a carburetor device having a compensating membrane and a fuel accumulating chamber which is connected through conventional idling and high-speed jets to a Venturi upstream from which there is provided an air intake manifold. Externally of the compensating membrane is a sealed chamber which communicates via a flexible tube with a compensating chamber which is maintained naturally or artificially at atmospheric pressure.

U.S. Pat. Nos. 5,368,510 and 5,538,449 (Richard) disclose a trolling valve safety device that locks or limits actuation of a boat engine throttle from its idle position.

U.S. Pat. No. 5,423,277 (Gai) discloses a safety device for helm, throttle and directional controls of watercraft which prevents a boat from perilously spiraling into a man thrown overboard by ensuring that the rudder does not flop to one side under normal water flow pressure.

U.S. Pat. No. 5,256,092 (Jones) discloses a carburetor-adjusting accessory harness for personal jet-propelled watercraft. This removably mounted harness enables one to finely tune the carburetor while the watercraft is operating unanchored and afloat without having to remove the hood.

U.S. Pat. No. 5,253,604 (Bohlin) discloses an electromechanical steering device, especially for boats, that comprises an electronic control unit capable of comparing an actual position signal generated by the steering wheel to a predetermined position signal and thus actuating a servo motor in accordance with the difference between said signals.

U.S. Pat. No. 5,090,929 (Rieben) discloses a paired motor system for small boat propulsion and steerage. Two spaced-apart electrically driven motors, which are variable, reversible and separately controllable by a joystick-type controller, provide differential propulsion for improved steering and maneuverability.

French Patent 2 687 364 (Cany et al) discloses an ergonomic, simplified control device for operating an outboard motor. A plurality of control cables links the outboard motor with a single, centrally mounted control stick.

U.S. Pat. No. 5,016,553 (Spencer) discloses a vector steering control system that features at least one thruster mounted transversely (perpendicular) to the stem drive propeller shaft. Turning of the steering wheel activates one of the thrusters whose thrust accelerates the stem of the boat in a direction perpendicular to the stem drive shaft.

U.S. Pat. No. 4,962,717 (Tsumiyama) discloses a control stick that allows a boat to be both steered and accelerated with a single hand.

European Patent Application 388 228 (Glen) discloses a control apparatus for controlling a plurality of outboard motors with a single tiller. The tiller has a twist grip that winds the control cables around a drum so that the throttle of each motor can be controlled by a positive pull-pull action.

U.S. Pat. No. 4,854,902 (Havins) discloses a boat speed and direction control system for controlling trolling motors which is operable in a hands-free manner so that a lone fisherman operating a craft equipped with such a system would not have to relinquish control of his rod and reel.

U.S. Pat. No. 4,739,236 (Burkenpas) discloses a portable helm that comprises a hand-held controller that can be plugged into multipin connector-sockets wired at various locations on the ship. The hand-held controller is able to control the angle of the rudders, the engine RPM and the direction of the power train (i.e. forward, neutral or reverse).

U.S. Pat. No. 3,976,026 (Eastling) discloses a slow-speed steering control for jet-powered watercraft having a steering plate (similar to a rudder) mounted parallel to, but beneath, the deflector plates that vector the thrust of the water exiting the exhaust port of the jet propulsion unit. The steering plate is mounted to, and moveable with, the deflector plates such that when the deflector plates are angled (by turning the steering wheel or handlebars) the steering plate moves as well. The steering plate is submerged so that it assists the steering of the boat when the deflector plates are turned. Even when no flow of water is exiting the jet propulsion unit, the submerged steering plate still produces a steering effect when the steering wheel or handlebars are turned. The steering plate is resiliently mounted to the deflector plates so that if the underside of the steering plate collides with land, the steering plate will rise.

U.S. Pat. No. 3,874,321 (Smith) discloses a boat steering and reversing system. This system provides a mechanism for rotating the propulsion unit about a vertical axis by means of a steering mechanism for normal steering and combining with this arrangement a reversing changeover control capable of rotating the propulsion unit by 180 degrees. The mechanism uses a throttle idler or clutch control to effect the changeover.

As evinced by the foregoing survey of related prior art, the closest prior art appears to be a watercraft adapted to carry a rudder on the underside of its hull. Such a rudder allows the watercraft to be maneuverable even when the steerable propulsion unit is not generating any thrust. However, such a rudder is unsuitable for many jet boats, personal watercraft, jet skis and motorboats because they preclude these watercraft from operating in shallow waters which is where these watercraft are commonly used. The rudder also precludes such a watercraft from being "beached" without risking damage to the rudder.

Thus, there is a need in the industry for an improved steering system for a watercraft equipped with a steerable propulsion unit.

OBJECTS AND STATEMENT OF THE INVENTION

It is thus an object of the present invention to provide an improved steering system for a watercraft equipped with a steerable propulsion unit.

It is another object of the present invention to provide a watercraft that can be steered effectively when the manual throttle control is off.

It is another object of the present invention to provide a watercraft whose throttle is coupled to the steering of the watercraft so that the throttle is opened when the watercraft is steered.

It is another object of the present invention to provide a watercraft with steer responsive throttle.

An additional object of the invention is to provide a watercraft with a steer responsive engine speed controller that functions to increase engine speed based on steering signals regardless of manual throttle control.

As embodied and broadly described herein, this invention seeks to provide a watercraft comprising a hull, and a steerable propulsion unit driven by an internal combustion engine that is capable of generating thrust and capable of steering the watercraft by directing the thrust in a desired direction. A manual throttle control is provided to control the speed of the internal combustion engine, and a manual steering control is provided for steering the watercraft. An actuator responsive to the manual steering control causes the steerable propulsion unit to generate a propulsive force at least equal to the minimum propulsive force necessary to effectively steer the watercraft when the manual steering control is turned in either direction beyond a predetermined angular threshold, whereby the watercraft can remain maneuverable independently of the manual throttle control setting.

When the manual steering control is turned beyond a certain, predetermined angular threshold, the actuator opens the throttle such that the propulsive force generated by the steerable propulsion unit is increased to a level corresponding to the minimal propulsive force needed to effectively steer the watercraft. This augmentation of propulsive force only occurs if the manual throttle control is set to produce a propulsive force less than the minimal propulsive force required for effectively steering the watercraft. Otherwise, if the manual throttle control is set to produce a thrust exceeding the minimal propulsive force required to effectively steer the watercraft, the throttle will remain open at the level set by the manual throttle control. Of course, if the manual throttle control is then reduced to below the threshold setting, the actuator causes the throttle to remain open so as to produce the minimal propulsive force necessary to effectively steer the watercraft. Thus, whenever the manual steering control is turned beyond the angular threshold, the actuator automatically ensures that the steerable propulsion unit generates the minimal propulsive force necessary for effectively steering the watercraft. Thus, the watercraft is maneuvered more easily since a turning thrust is automatically generated.

It is another object of the present invention to provide a watercraft with a steer-responsive engine assembly controlled by an electronic control system.

As embodied and broadly described herein, the present invention seeks to provide a watercraft comprising a hull, and a steerable propulsion unit driven by an internal combustion engine that is capable of generating thrust and capable of steering the watercraft by directing the thrust in a desired direction. A manual throttle control is provided for controlling the speed of the internal combustion engine, and a manual steering control is provided for steering the watercraft. An actuator is provided that is responsive to a signal for causing the steerable propulsion unit to generate a propulsive force at least equal to the minimum propulsive force necessary to effectively steer the watercraft for a given speed when the manual steering control is turned in either direction beyond a predetermined angular threshold, which causes the watercraft to remain maneuverable independently of the manual throttle control setting. The system also includes a steer angle measuring device for generating a steer angle signal representative of the steer angle of the steerable propulsion unit, a speed measuring device for generating a speed signal representative of the speed of the watercraft, and an actuator control circuit for generating an output signal for controlling the actuator. The actuator control circuit has a first input for receiving the steer angle signal, a second input for receiving the speed signal, and an output signal generator for generating an output signal in response to signals received at the first and second inputs. The output signal is applied to the actuator for controlling the actuator.

This steer-responsive engine assembly further incorporates an electronic control system that senses the steer angle of the manual steering control as well as the speed of the watercraft and then computes a setting that corresponds to a propulsive force appropriate for steering the watercraft.

Other objects and features of the invention will become apparent by reference to the following description and the drawings.

BRIEF DESCRIPTION OF THE DRAWINGS

A detailed description of the preferred embodiments of the present invention is provided below, by way of example only, with reference to the accompanying drawings, in which.

Figure 1:
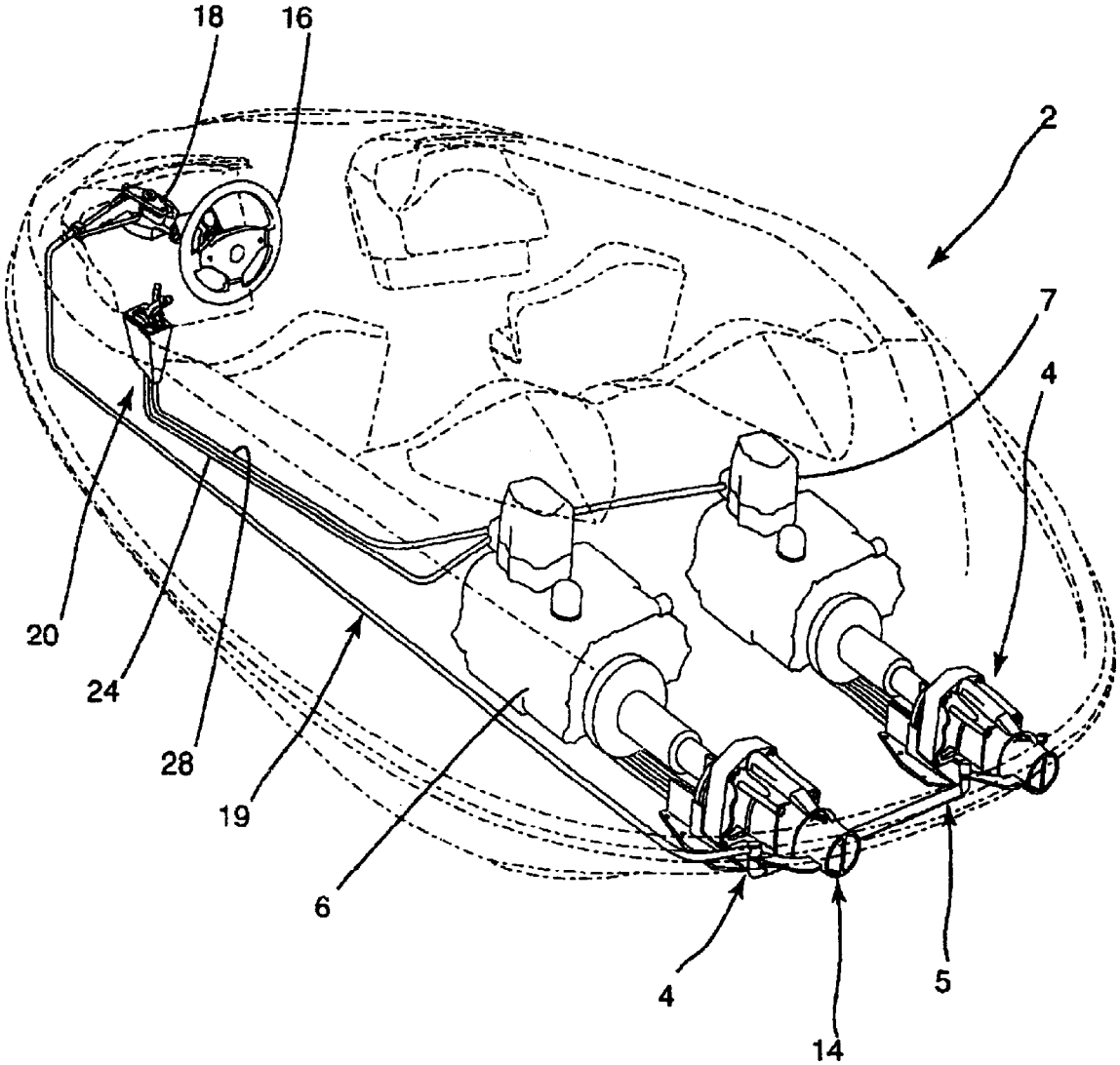
FIG. 1 is an isometric view of a watercraft's steerable propulsion system with a typical jet-propelled watercraft depicted in stippled lines.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE PREFERRED EMBODIMENTS

FIG. 1 illustrates in stippled lines a watercraft generally designated by the reference numeral 2. The watercraft 2 has a pair of steerable propulsion units 4. It should be noted that the watercraft could be a jet boat, a personal watercraft, a jet ski or a motorboat equipped with a swivel-mounted outboard motor. In fact, the present invention is applicable to any watercraft whose propulsion unit can be turned for steering the watercraft. The watercraft can have a single steerable propulsion unit, twin steerable propulsion units (as shown in FIG. 1) or a plurality of steerable propulsion units. When the watercraft has more than one steerable propulsion unit, there is usually a coupling link 5 that rigidly couples the steerable propulsion units together. In the case of a motorboat, there can be a single outboard motor or a plurality of outboard motors (which are usually coupled by a coupling link).

As shown in FIG. 1, by way of example only, the steerable propulsion units 4 are steerable jet propulsion units. Each propulsion unit has an internal combustion engine 6 which is typically a two-stroke engine. An example of a suitable engine for this application is a Rotax 787. This invention is, of course, equally applicable to watercraft having four-stroke engines or to watercraft having a single engine as opposed to two engines (as illustrated as the preferred embodiment). Each internal combustion engine 6 has a carburetor 7 for regulating the air-fuel mixture in the engine. A suitable carburetor for this application is a Mikuni BN40-38-16, although it should be obvious that virtually any carburetor can be adapted to make use of the present invention. It should be furthermore noted that this invention could be applied to watercraft that use electronic fuel injection systems rather than carburetors.

Figure 2:
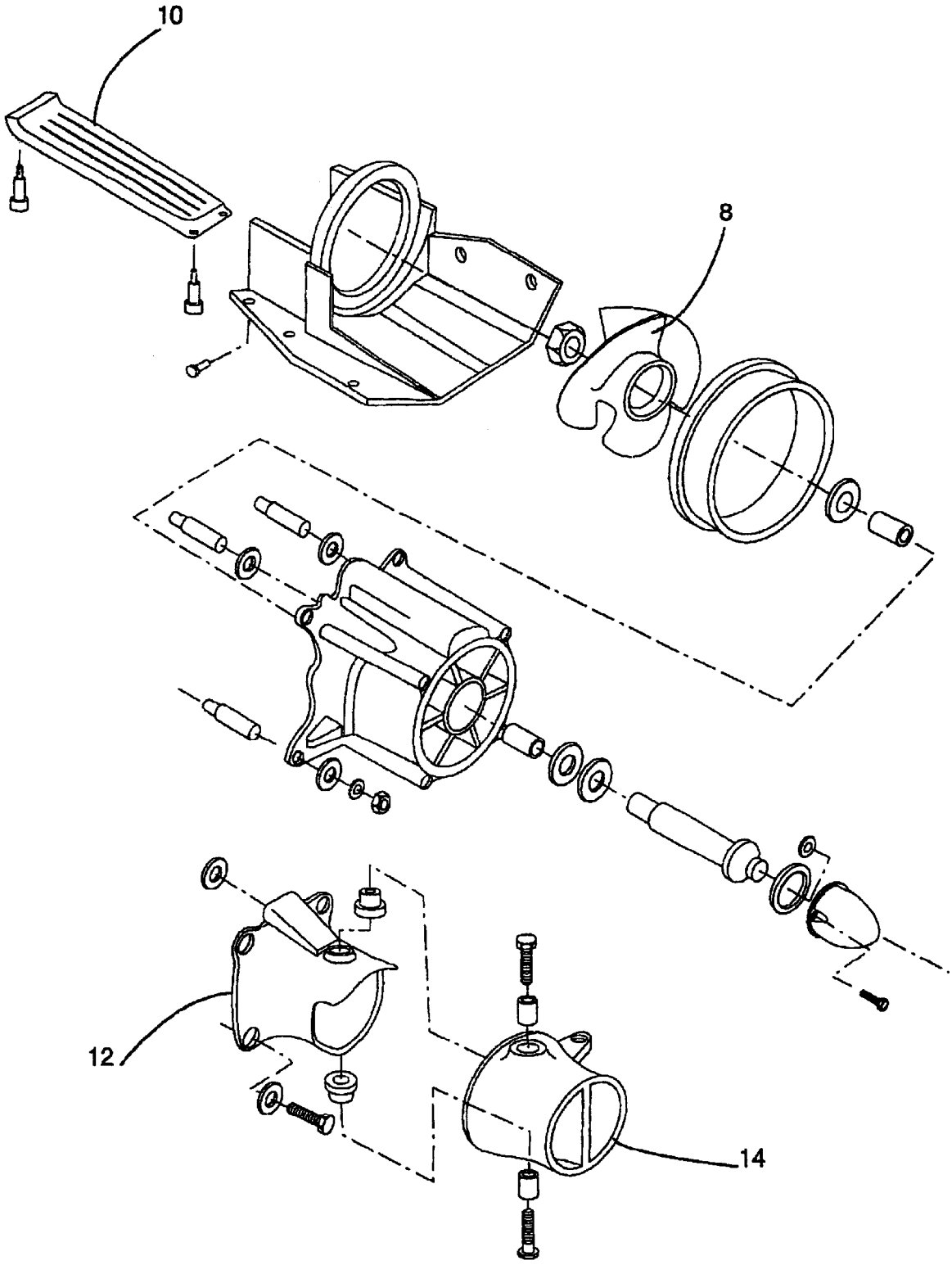
FIG. 2 is an exploded view of a steerable propulsion unit of a jet-propelled watercraft.

As illustrated in FIG. 2, the internal combustion engine 6 drives a stainless steel impeller 8, which draws water through an intake grating 10, and then discharges a jet of the water through a venturi 12. A steering nozzle 14 is pivotally mounted aft of the venturi for deflecting the jet of water exiting the venturi.

Referring back to FIG. 1, the steering angle of the steering nozzle 14 is controlled by a manual steering control such as a steering wheel 16 which actuates the steering nozzle 14 via a steering assembly 18 and a steering nozzle cable 19. In the case of a personal watercraft, the manual steering control would be a pair of handlebars. In the case of a motorboat, the manual steering control would be either a steering wheel or tiller. In any case, even the electronically controlled embodiments described below, turning the steering element causes a responsive steering movement to the propulsion device. In other words, turning the steering element generates a steering signal, which could be a mechanical, electronic or some other suitable signal.

The throttle of each carburetor 7 is controlled by a manual throttle control 20. This manual throttle control can be operated by hand or by foot. In the example provided herein, the manual throttle control has three hand-operated levers (which will be described in greater detail hereafter) for controlling the engine and the direction of travel. By activating the manual throttle control, the operator of the watercraft causes the throttle control cables 24, 28 to open and close the throttles of each carburetor.

Figure 3:
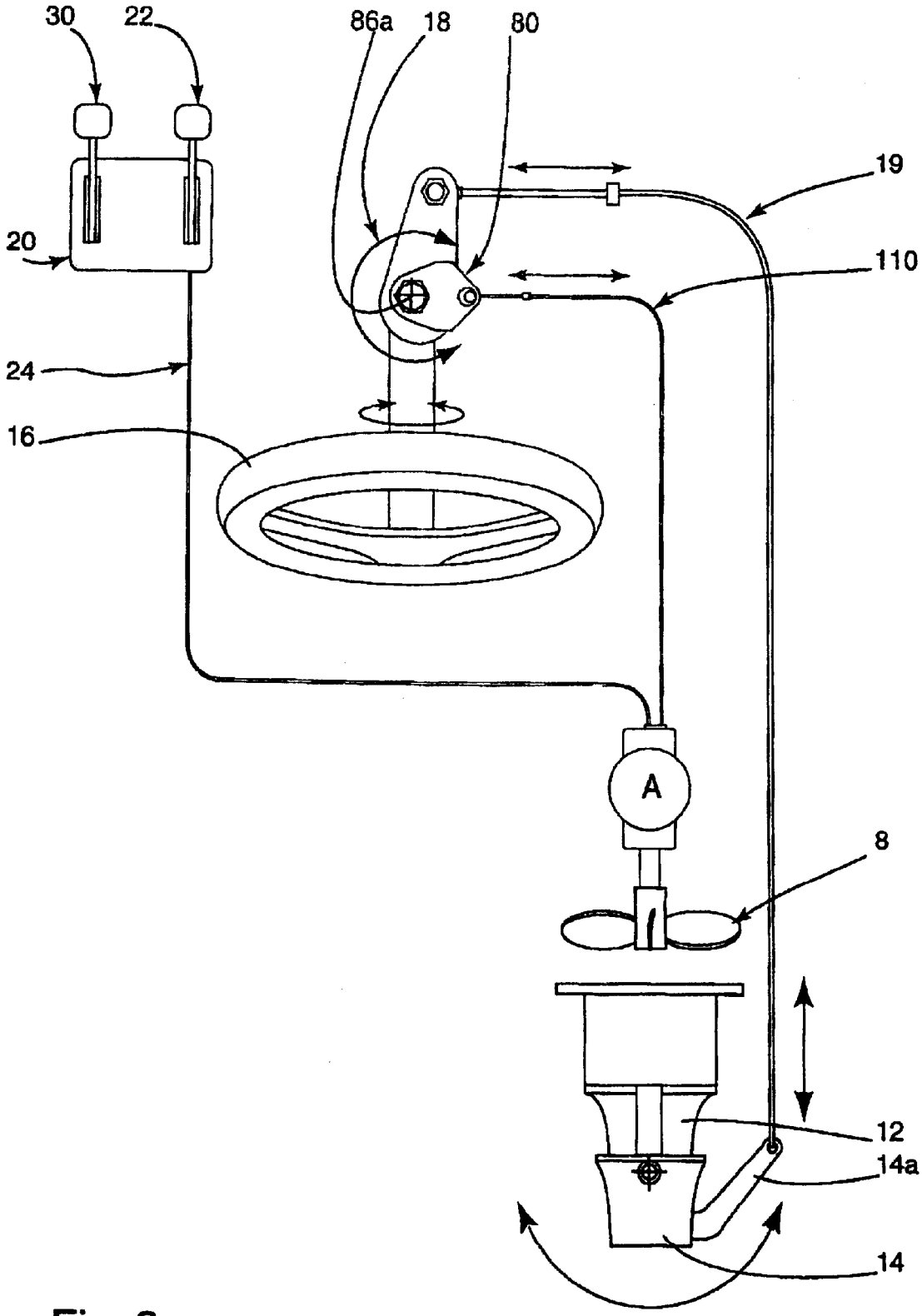
FIG. 3 is a schematic depicting the operation of a steer-responsive throttle on a watercraft equipped with a single steerable propulsion unit.

FIG. 3 is a schematic showing the operation of the steer-responsive throttle for a watercraft equipped with a single steerable propulsion unit 12. In this example, the watercraft has a steering wheel 16 that rotates a steering assembly 18. Connected to the steering assembly is a steering nozzle cable 19. The steering nozzle cable is also connected to a lever arm 14*a* affixed to a steering nozzle 14. Turning of the steering wheel thus causes the steering nozzle cable 19 to exert either a pushing or pulling force on the steering nozzle 14 thereby causing the steering nozzle to pivot about its pivot axis. A pivoting bracket 80 is mounted to the steering assembly 18. The bracket 80 is connected in a lost-motion arrangement to a throttle actuator cable 110. The throttle actuator cable 110 is connected to the throttle of the carburetor of powerplant A. (Powerplant A is the unit composed of the carburetor and engine). The throttle of powerplant A is also controlled by the manual throttle control 20 via the throttle control cable 24. Powerplant A drives the impeller 8 which discharges a jet of water through the venturi 12 and steering nozzle 14.

In operation, when the steering wheel 16 is turned, the steering assembly 18 rotates (as indicated by the circular arrows), exerting either a pulling force or a pushing force on the steering nozzle cable 19. Specifically, if the steering wheel is turned to the left, the steering assembly rotates clockwise and the steering nozzle cable then exerts a pushing force on the lever arm 14*a* of the nozzle 14, causing the nozzle to pivot clockwise. Analogously, if the steering wheel is turned to the right, the steering assembly rotates counterclockwise and the steering nozzle cable exerts a pulling force on the lever arm 14*a* of the nozzle 14, causing the nozzle to pivot counterclockwise.

If the steering wheel 16 is turned beyond a predetermined angular threshold, the bracket 80 (which pivots with the steering assembly) exerts a force on the throttle actuator cable 110. The bracket and throttle actuator cable are connected to one another in a lost-motion arrangement, meaning that the bracket must travel through a certain angular extent before it engages the throttle actuator cable.

If the manual throttle control is set at a throttle setting that produces a thrust less than what is needed to effectively steer the watercraft, the throttle actuator cable 110, will then open the throttle to produce the required thrust (or propulsive force) needed for proper steering. If the manual throttle control is already set so as to produce a large enough thrust to effectively steer the watercraft, then the throttle actuator cable 110 does not alter the throttle setting. Since the throttle actuator cable 110 is mounted to the bracket 80 in alignment with the pivot axis 86*a* of the bracket, the throttle actuator cable is actuated equally when the steering wheel is turned to the left or to the right.

Figure 4:
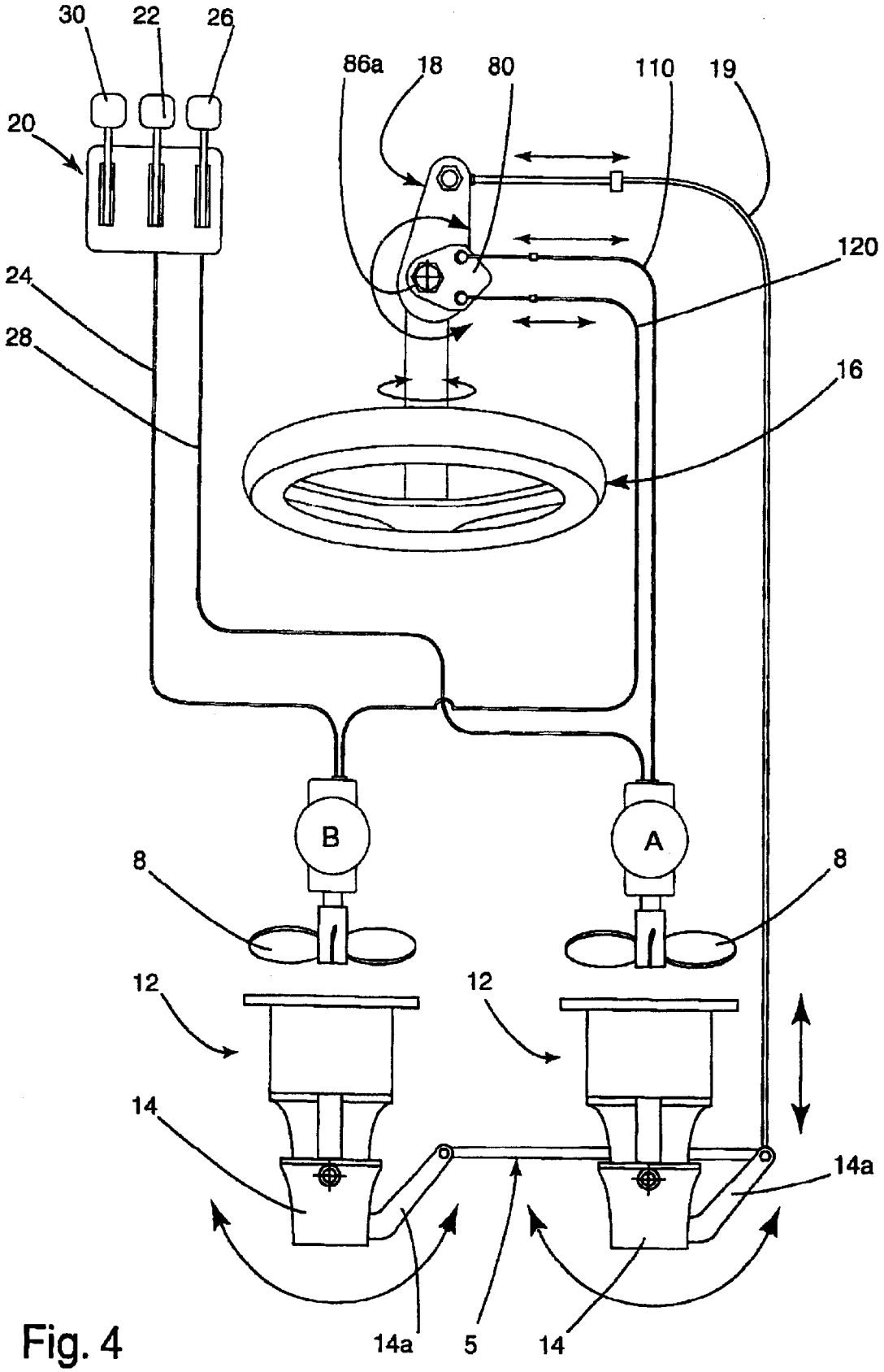
FIG. 4 is a schematic depicting the operation of a steer-responsive throttle on a watercraft equipped with a pair of steerable propulsion units.

FIG. 4 is a schematic showing the operation of the steer-responsive throttle for a watercraft equipped with twin steerable propulsion units 12. The watercraft has a steering wheel 16 that rotates a steering assembly 18. Connected to the steering assembly is a steering nozzle cable 19. The steering nozzle cable is also connected to the lever arm 14*a* affixed to the right steering nozzle 14. The right and left steering nozzles are rigidly coupled by a coupling link 5 so as to enable them to move in unison. Turning of the steering wheel thus causes the steering nozzle cable 19 to exert either a pushing or pulling force on the right steering nozzle 14 thereby causing the steering nozzles to pivot about their pivot axes. A pivoting bracket 80 is mounted to the steering assembly 18. The bracket 80 is connected in a lost-motion arrangement to a pair of throttle actuator cables 110, 120, meaning that the bracket must travel through a certain angular extent before it engages one of the throttle actuator cables. The throttle actuator cable 110 is connected to the throttle of the carburetor of powerplant A while the throttle actuator cable 120 is connected to the throttle of the carburetor of powerplant B.

The manual throttle control 20 has a lever 22 linked to a throttle control cable 24 for controlling the throttle of powerplant B. The manual throttle control 20 also has a lever 26 linked to a throttle control cable 28 for controlling the throttle of powerplant A. Both powerplants A and B drive their own impeller 8 and discharge a jet of water through their respective venturi 12 and steering nozzle 14.

In operation, when the steering wheel 16 is turned, the steering assembly 18 rotates (as indicated by the circular arrows), exerting either a pulling force or a pushing force on the steering nozzle cable 19. Specifically, if the steering wheel is turned to the left, the steering assembly rotates clockwise and the steering nozzle cable then exerts a pushing force on the lever arm 14*a* of the right nozzle 14, causing both nozzles to pivot clockwise. Analogously, if the steering wheel is turned to the right, the steering assembly rotates counterclockwise and the steering nozzle cable exerts a pulling force on the lever arm 14*a* of the right nozzle 14, causing both nozzles to pivot counterclockwise due to the coupling link 5.

If the steering wheel 16 is turned to the left beyond a predetermined angular threshold, the bracket 80 (which pivots clockwise with the steering assembly) exerts a force on the throttle actuator cable 120. No force is exerted on the throttle actuator cable 110 (i.e. the cable 110 remains slack). If the lever 22 of the manual throttle control 20 is set so that powerplant B generates a thrust less than what is needed to effectively steer the watercraft, the throttle actuator cable 120 will then open the throttle of powerplant B to produce the thrust needed for effective steering. If the lever 22 of the manual throttle control is set so that powerplant B is already producing a large enough thrust to effectively steer the watercraft, then the throttle actuator cable 120 does not alter the throttle setting.

Similarly, if the steering wheel 16 is turned to the right beyond a predetermined angular threshold, the bracket 80 (which pivots counterclockwise with the steering assembly) exerts a force on the throttle actuator cable 110. No force is exerted on the throttle actuator cable 120 (i.e. the cable 120 remains slack). If the lever 26 of the manual throttle control 20 is set so that powerplant A generates a thrust less than what is needed to effectively steer the watercraft, the throttle actuator cable 110 will then open the throttle of powerplant A to produce the thrust needed for effective steering. If the lever 26 of the manual throttle control is set so that powerplant A is already producing a large enough thrust to effectively steer the watercraft, then the throttle actuator cable 110 does not alter the throttle setting.

In the most preferred embodiment, the throttle of only one of the two poverplants is opened when the steer angle exceeds the angular threshold. When the steering wheel is turned to the left, the throttle of the left propulsion unit (i.e. the throttle of powerplant B) is opened. Similarly, when the steering wheel is turned to the right, the throttle of the right propulsion unit (i.e. the throttle of powerplant A) is opened. Though this may at first seem counterintuitive, the actuation of the throttles of powerplants A and B by throttle actuator cables 110 and 120, respectively, is designed to favor the steering of the watercraft in reverse. This improves the watercraft's maneuverability when backing toward a dock. When turning left in reverse, the throttle of powerplant B is opened and the jet of water produced by the left propulsion unit is deflected rearward by a left-hand reverse gate. The vector of the thrust generated by powerplant B is offset from the longitudinal plane of symmetry of the watercraft. The thrust multiplied by the perpendicular offset distance contributes a small, additional turning moment to the main turning moment produced by the water jet exiting the steering nozzle.

It should be noted that the throttle actuator cable 110 could be routed to actuate powerplant B while throttle actuator cable 120 could be routed to actuate powerplant A. This arrangement would improve forward steering at the slight expense of reverse steering. It would furthermore be possible to have either throttle actuator cable 110, 120 able to actuate both powerplants simultaneously. This would necessitate the bifurcation or splitting of each throttle actuator cable with a Y-connector.

Figure 5:
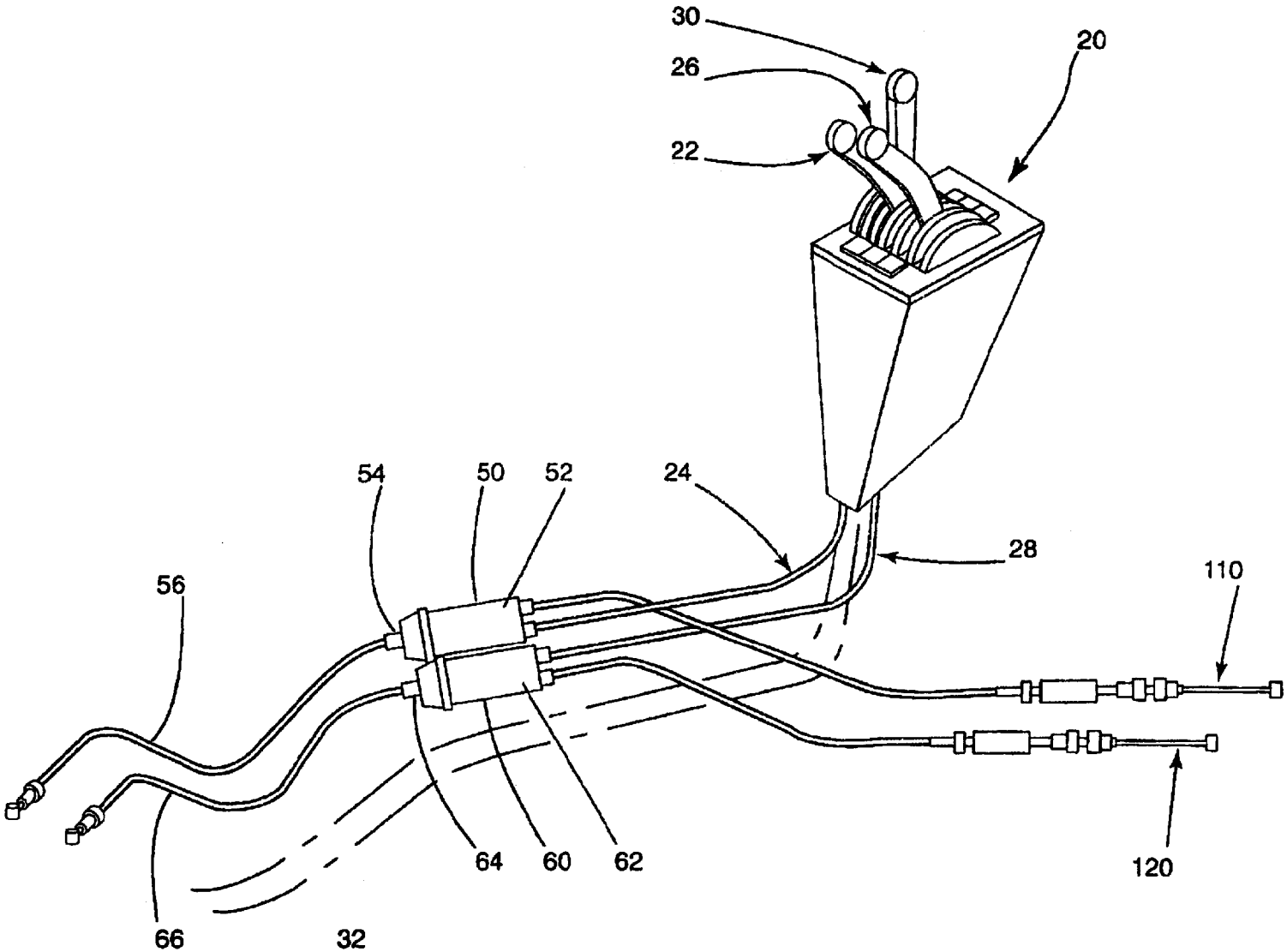
FIG. 5 is a schematic depicting a manual throttle control and throttle cables which merge with cables from the steering assembly for controlling the throttle.

FIG. 5 illustrates the manual throttle control 20 of a twin-engine watercraft. The manual throttle control 20 comprises three levers 22, 26 and 30. A first lever 22 is a left-hand manual throttle lever which is connected via the throttle control cable 24 to the throttle of the left-hand propulsion unit. A second lever 26 is a right-hand manual throttle lever which is connected via the throttle control cable 28 to the throttle of the right-hand propulsion unit. The manual throttle levers 22, 26 are for independently controlling the two engines of the watercraft and the thrust of the water exiting each jet propulsion unit. A third lever 30 (also known as a shift lever) is for selecting forward, reverse and neutral modes of the watercraft. The shift lever is connected to a shift cable 32 capable of engaging and disengaging the drive shaft and activating the reverse gates.

The left and right engines may be controlled independently by adjusting the lefthand and right-hand throttle levers 22 and 26. By separately adjusting and controlling the throttle levers 22 and 26, the operator of the watercraft can separately control each of the engines and manipulate the performance and directional control of the watercraft. Some twin-engine watercraft comprise separate manual throttle levers for each of the engines, but only a single steering cable for the corresponding steering nozzles. In this specific configuration, the steering nozzles are coupled together. Furthermore, in a single-engine watercraft, there are normally only two levers, one shift lever for selecting forward, reverse and neutral modes and a manual throttle lever for controlling the engine.

Figure 6:
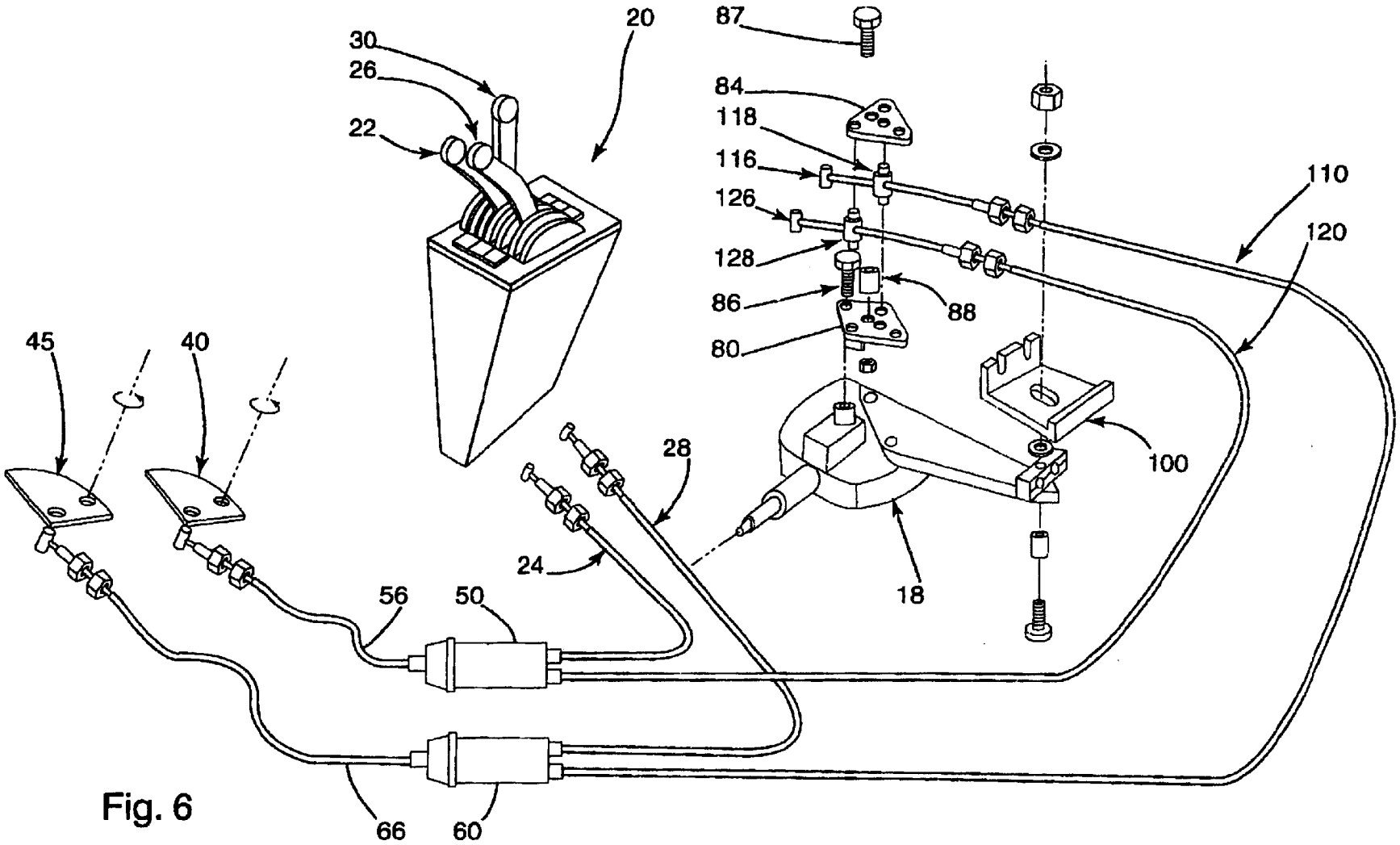
FIG. 6 is an exploded view of the basic components of a steer-responsive throttle in accordance with a first embodiment of the present invention.

As illustrated in FIG. 6, the left throttle control cable 24 (extending from the left manual throttle lever 22) is connected to a left slide coupler 50. Also connected to the left slide coupler is the throttle actuator cable 120. Displacement of either cable 24 or 120 causes the left slide coupler to actuate a throttle lever 40 on the left carburetor. Similarly, the right throttle cable 28 (extending from the right manual throttle lever 26) is connected to a right slide coupler 60. Also connected to the right slide coupler is the throttle actuator cable 110. Displacement of either cable 28 or 110 causes the right slide coupler to actuate a throttle lever 45 on the right carburetor.

Figure 7:
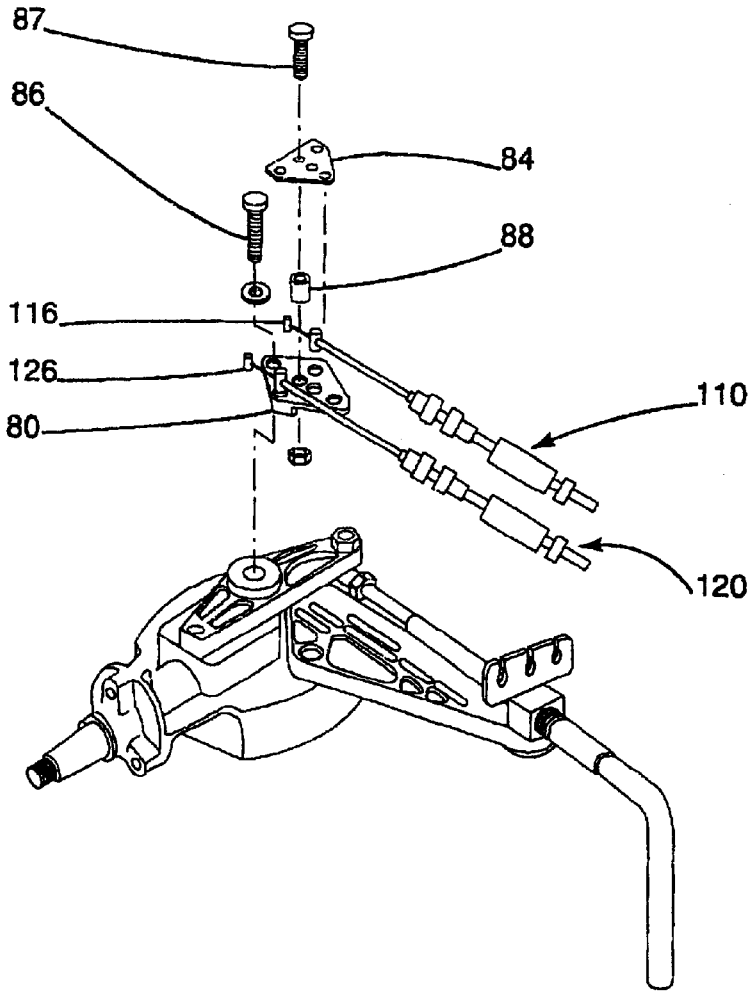
FIG. 7 is an exploded view of the connection of the throttle actuator cables to the steering assembly in accordance with the first embodiment of the invention.

As shown in FIGS. 6 and 7, the left and right throttle actuator cables 110, 120 have left and right stoppers 116, 126 at their tips. Each throttle actuator cable is routed through a hole in a cylinder. The left throttle actuator cable 110 is routed through a hole in a left cylinder 118 while the right throttle actuator cable 120 is routed through a hole in a right cylinder 128. Each cylinder has a top and a bottom protuberance. The bottom protuberances engage holes on the bracket 80 while the to p protuberances engage corresponding holes on a cover bracket 84. The cylinders are thus sandwiched between the bracket and the cover bracket.

Figure 8:
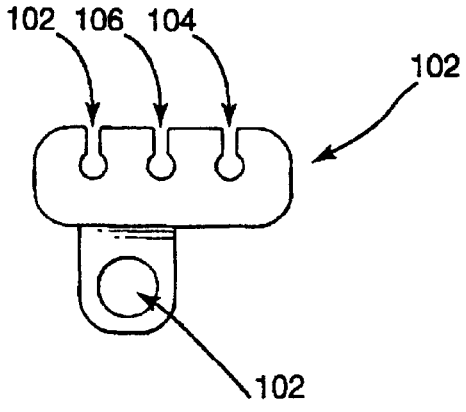
FIG. 8 is a plan view of the cable-supporting bracket shown in FIG. 7.

The bracket and cover bracket are held together with a fastener 87. The fastener is fed through a cylindrical spacer 88, which ensures that the proper gap between the bracket and cover bracket. The bracket 80 is mounted to the steering assembly by virtue of a fastener 86. The throttle actuator cables are supported by a cable support 100, illustrated in FIG. 8. For twin-engine watercraft, the cables rest in outer grooves 102 and 104. For single-engine watercraft, the cable rests in a central groove 106. In operation, the rotation of the steering assembly causes the bracket 80 to rotate. Depending on the direction of rotation, either the left or right throttle actuator cable is actuated when the steering wheel is turned beyond the predetermined angular threshold. The bracket 80 pivots until one of the cylinders collides with its stopper. Further rotation of the bracket results in an actuating tension to be created in the corresponding throttle actuator cable. It stands to reason that, for the configuration illustrated, only one of the throttle actuator cables can be actuated at a time. When one cylinder has collided with its stopper, the other cylinder has moved farther from its stopper, meaning that its cable will remain slack.

FIG. 6 also illustrates the interaction between the throttle actuator cables and the corresponding throttle control cables. The throttles may be opened and closed by either the throttle control cables 24, 28 or the throttle actuator cables 110, 120. If the operator has opened the throttle manually (via cables 24, 28) to a level that generates the required minimal propulsive force for steering, the actuation of the throttle actuator cables (from turning the steering wheel) has no impact on the throttles. Similarly, if one of the throttle actuator cables becomes taut (and is exerting a pulling force on its corresponding slide coupler), the counterpart control cable is slack unless the corresponding lever on the manual throttle control is displaced manually beyond the throttle setting. Thus, the tension in each cable 56, 66 is equal to the greater of the tension in either the throttle actuator cables or the throttle control cables. Finally, it should be noted that a steer-responsive throttle system can operate with or without a slide coupler. The slide coupler simply merges the throttle cables so that the throttle is opened by whichever cable exerts the greater pulling force. The slide coupler can be eliminated, as shown in the foregoing schematics (FIGS. 3 and 4) by simply routing the throttle cables directing to the throttle. The throttle lever (or valve) is opened by the greater of the forces exerted on it by either the throttle actuator cables or the throttle control cables.

As illustrated in FIGS. 6 and 7, the steer-responsive throttle system comprises a cable support 100 which is attached to the steering assembly 18. The cable support 100 has an aperture 135 for securing the cable support 100 to the steering nozzle cable 19 adjacent to an end of the support arm 146. In a twin-engine watercraft, there is a first cable 110 and a second cable 120 extending from each of the left and right slide couplers 50 and 60 to the cable support 100. The first cable 110 is attached to the left slide coupler 50 and is mounted to a first slot 102 of the cable support. Similarly, the second cable 120 is attached to the right slide coupler 60 and is mounted to a third slot 104 of the cable support 100. In a single-engine watercraft, there is only a single cable extending from a single slide coupler to the cable support 100 and the single cable is mounted in the center slot 106 of the cable support 100.

The steering assembly 18 further comprises a bracket 80 mounted on a top surface area of the steering assembly 18, as shown in FIGS. 6 and 7. The bracket 80 comprises an aperture 82 for receiving a screw for securing the bracket 80 to the steering assembly 18. The bracket further comprises a plurality of apertures for receiving and containing the cylinders 118 and 128. In a single-engine arrangement, the bracket 80 is adapted to receive and contain a single cylinder in the central slots of the bracket 80 and the bracket cover 84. As illustrated in FIGS. 6 and 7, the ends of the first and second cables 110 and 120 each comprise a stopper 116 and 126, respectively. The stoppers 116 and 126 are permanently affixed to the end of each of the first and second cables 110 and 120 and are received by the respective cylinders lodged between the bracket and bracket cover. Accordingly, the ends of the first and second cables are indirectly attached in a lost-motion arrangement to the bracket 80 by means of the stoppers 116 and 126.

The cover bracket 84 fits over a top surface of the bracket 80. The cover bracket 84 comprises a plurality of apertures for receiving screws 86 which secure the cover bracket 84 to the bracket 80. The steering assembly 18 further comprises a spacer 88 disposed between the bracket 80 and the cover bracket 84, to provide space (a gap) therebetween for receiving the cylinders adjacent to the stoppers of the first and second cables 110 and 120. Each of the cylinders can abut the stoppers 116 and 126 to engage one of the cables 110, 120. In a single-engine arrangement, the steering assembly comprises a single cylinder for engaging a stopper and thus actuating a single cable. The bracket 80, cover bracket 84 and the cylinders are rotatable with the steering assembly (when the steering wheel is turned) and allow the first and second cables 110 and 120 to be actuated when the rotational movement of the steering wheel exceeds the threshold. When the steering wheel exceeds the angular threshold, one of the cylinders abuts its corresponding stopper, thereby causing its actuator cable to actuate its corresponding throttle. As the steering wheel is rotated, the steering nozzle cable 19 is pulled or pushed, causing the exit nozzle to pivot. In addition, the cylinders are adapted to pull the cables 110 and 120 by means of the corresponding stoppers 116 and 126, depending upon the directional rotation of the steering wheel 142.

When the watercraft is at rest, the stoppers 116 and 126 of each of the respective cables 110 and 120 are not in contact with their respective cylinders. Accordingly, as the steering wheel is rotated in a clockwise or counterclockwise direction, the cylinders rotate together with the bracket 80 and the cover bracket 84.

At such time as the manual throttle levers 22 and 30 are in an off position, the steering wheel may be rotated to a given clockwise position in order to activate the steer-responsive throttle. When the manual throttle levers are set in an "off" position, the engine is calibrated to idle. The engine may be shut off only by activation of a separate kill-switch. Clockwise rotation of the steering wheel from a center position to the left causes the cylinder 128 to abut the stopper 126 of the second cable 120. The left slide coupler 50 is pulled, causing the throttle of the left engine to be opened.

Similarly, at such time as the manual throttle levers 22 and 30 are in an off position, the steering wheel may be rotated to the right (i.e. in a counterclockwise direction). The rotation of the steering wheel causes the cylinder 118 to abut the stopper 116 of the first cable 110. The right slide coupler 60 is pulled, causing the throttle of the right engine to be opened. When the steering wheel is returned to a straight-ahead position from a given clockwise or counterclockwise rotation, the first and second cables 110 and 120 return to their rest positions.

The left and right slide couplers 50 and 60 control activation of the left and right engines of the watercraft via either the manual throttle control (also known as the "throttle assembly") 20 or the steering assembly 18. The slide couplers 50 and 60 respond to the manual throttle levers 22 and 26 as well as the steering wheel. The proximal ends 52, 62 of the slide couplers 50, 60 are adapted to receive both the first and second cables 24, 28 from the first and second manual throttle levers 22, 26 as well as the first and throttle actuator cables 110, 120 from the cable support 100 and the steering assembly 18. However, the distal ends 54, 64 of the slide couplers comprise only one cable extending from each of the slide couplers. A first cable 56 extends from the left slide coupler 50 to the left carburetor's throttle lever 40, and a second cable 66 extends from the right slide coupler 60 to the right carburetor's throttle lever 45. Both the first cable 56 and the second cable 66 independently control actuation of the throttles of the carburetors of the respective engines.

Upon activation of either the first manual throttle lever 22 or the second manual throttle lever 26, the respective cable extending to the slide coupler actuates the cable extending to the throttle lever on the respective carburetor. The same action causes the activated slide couplers to tighten control on the activated cables and to provide an increased backlash (slack) in the cable extending from the slide coupler to the steering assembly. The increased backlash in the cables 110 and 120 extending from the slide coupler to the steering assembly 18 allows directional control of the watercraft by the steering assembly 18 through the steering nozzle cable 19 without adjusting the throttle lever of the carburetor. Accordingly, this arrangement allows standard directional control of a watercraft by means of the steering assembly 18 at such time as the manual throttle lever is activated to control the thrust of the water exiting the jet propulsion unit.

Rotation of the steering wheel in a clockwise direction causes the right cylinder 118 to abut the stopper 116 thereby pulling on the first cable 110 attached to the proximal end 62 of the right slide coupler 60. This rotation of the steering wheel further causes a backlash in the throttle control cable 28 extending from the right slide coupler 60 to the second manual throttle lever 26. Furthermore, the clockwise rotational movement allows the first cable 110 to open the throttle of the right engine.

Similarly, rotation of the steering wheel in a counterclockwise direction causes the left cylinder 128 to abut the stopper 126 thereby pulling on the second cable 120 attached to the proximal end 52 of the left slide coupler 50. This rotation of the steering wheel further causes a backlash in the throttle control cable 24 extending from the left slide coupler 50 to the first manual 22. The counterclockwise rotation opens the throttle of the left engine.

Actuation of the throttles by turning the steering wheel beyond the predetermined angular threshold may produce from about 0 to about 50 pounds of thrust exiting the jet propulsion unit and an engine speed from about 0 to about 3,000 revolutions per minute. However, the engine speed and thrust generated by rotation of the steering wheel may be calibrated as required for different types of watercraft. The amount of thrust produced by turning the steering wheel beyond the threshold is sufficient to enable control of directional movement of the watercraft by the operator. The minimal thrust produced by rotation of the steering wheel assists the operator in docking procedures as well as other low speed maneuvers. The necessary degree of rotation of the steering wheel from a neutral position may be approximately 180 degrees to generate a maximum thrust and speed. However, the degree of rotation may be separately calibrated for different watercrafts. The predetermined angular threshold (i.e. the steer angle at which a stopper engages a cylinder and thus actuates a throttle) depends upon the calibration of the system. Accordingly, the rotation of the steering wheel produces sufficient thrust to enable proper steering of the watercraft.

In an alternative embodiment, the steer-responsive throttle may comprise a series of electronic controls and wires. This embodiment comprises a steering assembly having sensors or switches for detecting the degree of rotation of the steering wheel. In addition, the carburetor comprises a separate set of switches for controlling the air-fuel mixture entering each of the respective carburetors. At such time as the manual throttle levers 22 and 26 are set to an off or low-thrust position, the steering wheel may be rotated to a given degree in a clockwise or counterclockwise direction. When the steering wheel is rotated in a clockwise direction a first set of sensors or switches adjacent to the steering wheel causes the throttle of the right carburetor to open.

Similarly, as the steering wheel is rotated in a counterclockwise direction the first set of sensors or switches adjacent to the steering wheel causes the throttle of the left carburetor to open. In a preferred embodiment, the carburetor is a solenoid switch. The switches and sensors adjacent to the steering wheel are connected to the solenoid switches adjacent to the corresponding right and left carburetors by means of electronic wires. In this preferred embodiment, an electric current is sent through the wires from the steering assembly to the carburetors, thereby controlling the air-fuel mixture in each of the respective carburetors and controlling the engine speed and thrust of the water exiting the jet propulsion unit. When the steering wheel is returned to a neutral maneuvering position, the sensors and switches adjacent to the steering assembly cause the throttle actuators adjust the carburetors so that the watercraft's engines return to a neutral idling position.

Figure 9:
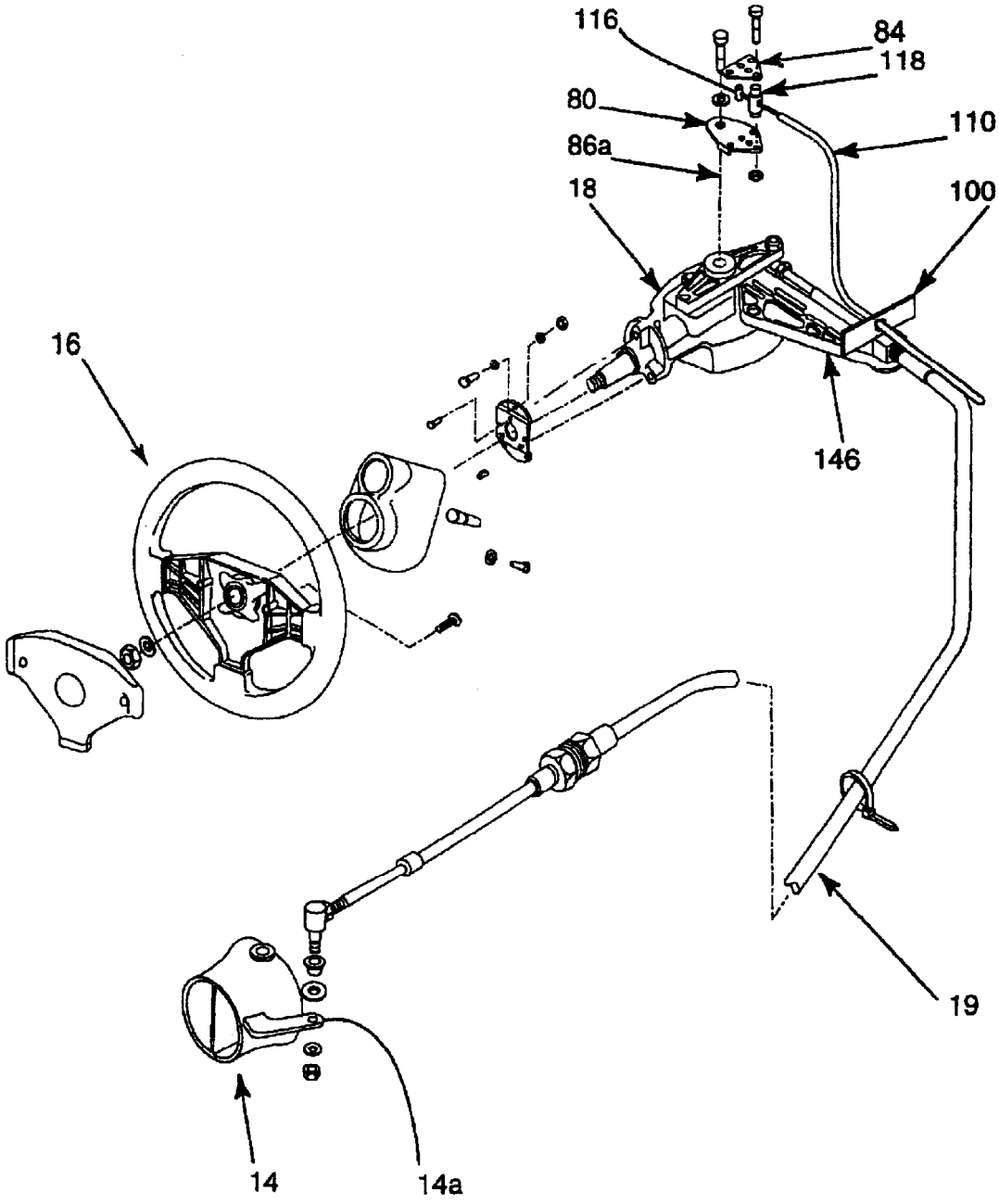
FIG. 9 is an exploded view of a steering system with a single throttle actuator cable linked to a steer-responsive throttle in accordance with the first embodiment of the invention.
Figure 10:
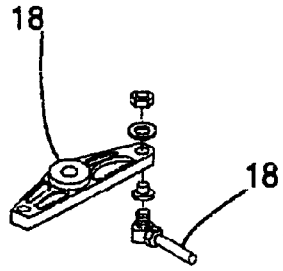
FIG. 10 is an enlarged view of the connection between the steering nozzle cable and the steering assembly of FIG. 9.
Figure 11:
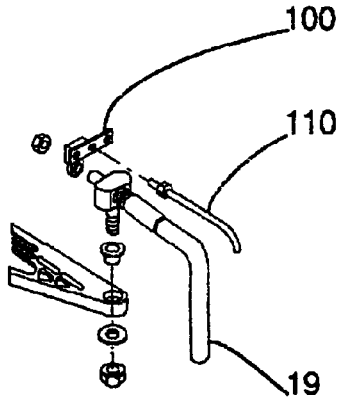
FIG. 11 is an enlarged view of the connection between the throttle actuator cable and the bracket of FIG. 8.

Shown in FIGS. 9–11 is a steer-responsive throttle system for a single-engine watercraft, such as a PWC. The steering wheel 16 is connected to the steering assembly 18. The steering assembly contains either bevel gears or worm gears to convert the rotation of the steering wheel into a rotation of a portion of the steering assembly about the pivot axis 86*a*. By turning the steering wheel, the steering assembly exerts a pushing or pulling force on the steering nozzle cable 19 which, in turn, causes the nozzle 14 to pivot. As the steering wheel is turned, the rotation of the steering assembly also causes the bracket 80, which is mounted to the steering assembly, and the bracket cover 84, which is fastened to the bracket 80, to pivot. Sandwiched between the bracket 80 and the bracket cover 84 (and thus rotatable therewith) is a single cylinder 118. The cylinder has top and bottom protuberances that mate with corresponding holes in the bracket and bracket cover. The cylinder also has a hole that is normal to the longitudinal axis of the cylinder through which the throttle actuator cable 110 can translate. The throttle actuator cable 110 is supported by cable support 100 and has a stopper 116 at one end. The stopper is sized so that it cannot pass through the hole in the cylinder. The length of cable or wire that extends from the cylinder to the stopper corresponds to the extent of lost motion in the mechanism. The cylinder 118 is aligned with the pivot axis 86*a* such that rotation of the bracket clockwise or counterclockwise will result in symmetrical actuation of the throttle. If the steering wheel is turned to the right, the steering assembly pivots counterclockwise (as seen from above) and the cylinder eventually abuts the stopper. Similarly, if the steering wheel is turned to the left, the steering assembly pivots clockwise (as seen from above) and the cylinder also eventually abuts the stopper. If the steering wheel is turned far enough to either side, the cylinder will abut the stopper as the bracket pivots past the threshold. Once the cylinder has collided with the stopper, the throttle actuator cable 110 becomes taut. Further rotation of the bracket (by further turning the steering wheel) causes the throttle actuator cable to pull open the throttle so that the propulsion unit produces a thrust suitable for steering the watercraft. The throttle can, of course, also be controlled by the manual throttle control. Thus, only if the manual throttle control is set to produce a thrust less than what is needed for steering can the throttle actuator cable 110 actuate the throttle.

Figure 13:
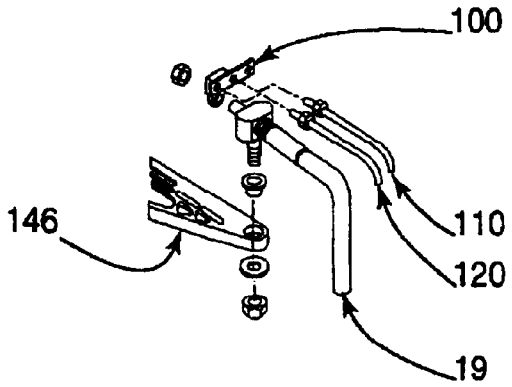
FIG. 13 is an enlarged view of the connection between the throttle actuator cables and the bracket of FIG. 8.
Figure 12:
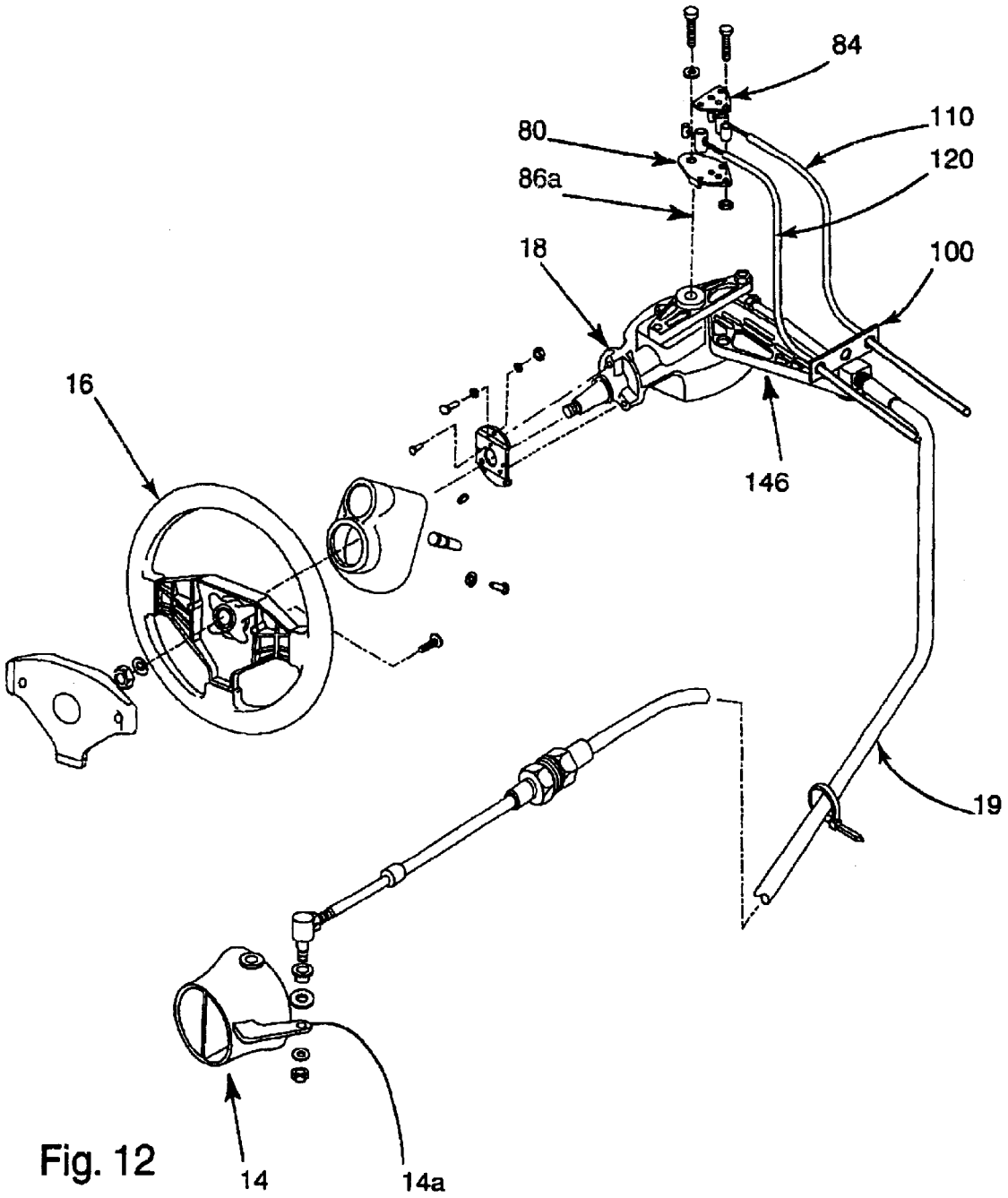
FIG. 12 is an exploded view of a variant of the steering system of FIG. 9 with a pair of throttle actuator cables linked to their respective steer-responsive throttles.

Shown in FIGS. 12–13 is a steer-responsive throttle system for a twin-engine watercraft, such as a jet boat. The system functions similarly to the single-engine configuration except that there are two throttle actuator cables 110, 120. When the steering wheel is turned to the right, the bracket pivots counterclockwise (as seen from above) until the right cylinder collides with the right stopper. Meanwhile, the left throttle actuator cable 120 remains slack. Similarly, when the steering wheel is turned to the left, the bracket pivots clockwise (as seen from above) until the right cylinder collides with the right stopper. The right throttle actuator cable 110 then pulls open the throttle of the right engine. Meanwhile, the left throttle actuator cable 120 remains slack. Similarly, when the steering wheel is turned to the left, the bracket pivots clockwise (as seen from above) until the left cylinder collides when the left stopper. The left throttle actuator cable 120 then pulls open the throttle of the left engine. Meanwhile, the right throttle actuator cable 110 remains slack.

Figure 14:
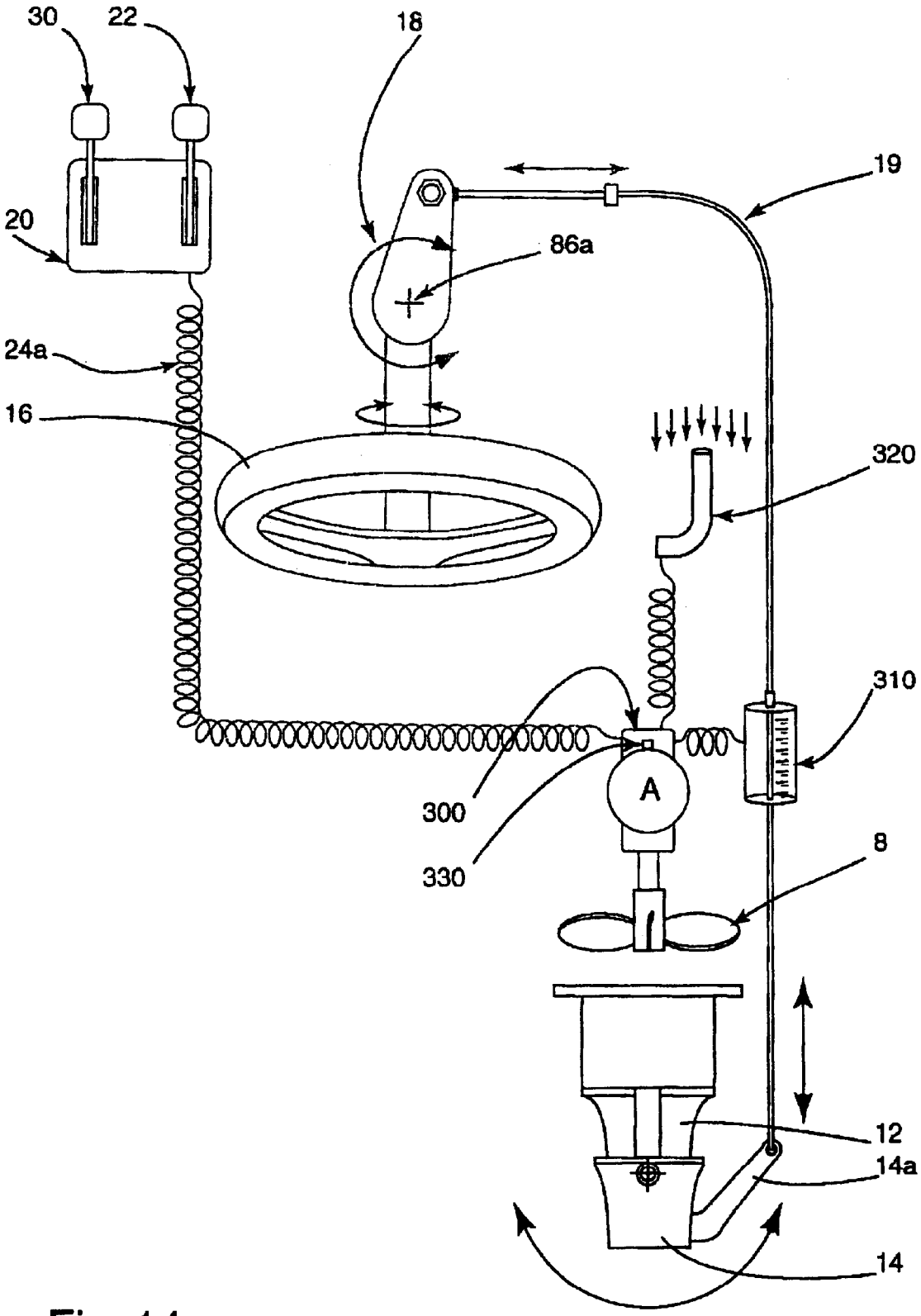
FIG. 14 is a schematic depicting a second embodiment of the steer-responsive system in accordance with the present invention, the engine speed being controlled by a control system.

As depicted in FIG. 14, a watercraft with a steer-responsive throttle may comprise, as an alternative, preferred embodiment, an electronic control system to regulate the thrust of the propulsion unit as a function of the watercraft's speed and the angle of the steering nozzle. The schematic shown in FIG. 14 is similar to the one shown in FIG. 3. Unlike the purely mechanical system shown in FIG. 3, the electronically controlled system of FIG. 14 does not employ throttle actuator cables linking the steering assembly to the throttle. Though not explicitly illustrated, it should be apparent that this electronically controlled steer-responsive throttle is equally applicable to single-engine and twin-engine watercraft.

The configuration shown in FIG. 14 is for a single-engine watercraft. A steering wheel 16 connected to a steering assembly 18. A portion of the steering assembly rotates about pivot axis 86*a*. The rotation of the steering assembly causes the steering nozzle cable 19 to be pushed or pulled. The steering nozzle cable, in turn, exerts either a forward or rearward force on the lever arm 14*a* affixed to the steering nozzle 14. The force pivots the steering nozzle 14 clockwise for a left turn or counterclockwise for a right turn. The operator can control the throttle opening and hence the thrust generated by the impeller 8 of the propulsion unit 12 by manually displacing the manual throttle lever 22 of the manual throttle control 20. The shift lever 30 is displaced to select forward, reverse or neutral modes of operation. The manual throttle lever 22 opens and closes the throttle of powerplant A via a throttle control wire 24a which conveys an electrical signal to a throttle control system module 300. The control system module 300 also comprises a processor, an output signal generator and an actuator for opening and closing the throttle.

A steering sensor 310 measures the linear displacement of the steering nozzle cable 19. The steering sensor 310 sends an electrical signal to the control system module 300. This steering sensor could be a linear voltage displacement transducer (LVDT). Equivalently, a steering sensor could be mounted on the steering nozzle, on the steering wheel or on the steering assembly so long as the steering sensor yields a signal that is proportional to the steer angle of the nozzle. The steering sensor will be either a linear displacement sensor or an angle sensor, depending on the application. Alternatively, a pair of electric switches can be used to activate the throttle when the steering wheel has reached either the left or right angular threshold. With electric switch actuation, the throttle is opened to a predetermined setting (i.e., with such a "step-response", the system is either on or off) whereas with a steer sensor, the thrust can be gradually increased as a function of the steer angle.

A speed sensor 320 measures the forward speed of the watercraft. In this preferred embodiment, the speed sensor is a pitot tube for measuring air speed. The pitot tube comprises a transducer for converting the pressure reading of the pitot tube into an electrical signal proportional to the speed of the watercraft. (The differential between the dynamic pressure at the stagnation point inside the pitot tube and the ambient pressure is related to the air speed by Bernoulli's Equation.) This pitot tube, or speed sensor, sends the signal to the electronic control module 300. Equivalently, the pitot tube can be placed under the watercraft to measure water flow velocity. Alternatively, the speed sensor can be a submerged rotor or water wheel capable of emitting an electric pulse per revolution. The frequency of the pulses can be readily calibrated to the water flow velocity. The air speed pitot tube is preferred because a device that protrudes from the hull will detrimentally affect the hydrodynamics of the hull.

The electronic control module 300 calculates the optimal throttle opening for effectively steering the watercraft based on the input signals from the steering sensor 310 and the speed sensor (pitot tube) 320. A throttle position sensor (TPS) 330 measures the actual position of the throttle, which is essentially a measurement of how much the throttle is open. The electronic control module generates an output signal that activates a throttle actuator only when the measured throttle setting is less than the desired throttle setting for a given speed and steer angle. In other words, the output signal is only generated if the signal from the manual throttle control corresponds to a throttle setting that will produce a thrust less than what is needed to steer the watercraft. The throttle actuator opens and closes the throttle so as to optimize the thrust for steering. In the preferred embodiment, the control module will increase the opening of the throttle as the watercraft speed increases in a non-linear fashion. For the purposes of illustration only, the throttle may be set so that the engine idles at 2000 RPM for a speed of zero knots. For a speed of 10 knots, the throttle may be opened so that the engine runs at 2600 RPM. For a speed of 20 knots, the throttle may be opened to produce an engine speed of 2900 RPM. The optimal throttle setting can be determined empirically by measuring the thrust needed to effectively steer the watercraft and by correlating that thrust to the impeller's speed of rotation, the engine RPM, and the throttle setting. of course, the thrust needed to effectively steer the watercraft depends on the size and type of watercraft.

For steady-state operation, the throttle opening is readily correlated with the thrust of the water jet exiting the nozzle. However, there is a response lag between the opening of the throttle and the increase in engine speed. There is a further response lag between the increase in engine speed and the increase in thrust. Since the parameter that is to be ultimately controlled is the actual thrust of the water jet, it might appear to be sensible to replace the TPS with a pitot tube aft of the impeller. Such a pitot tube measures dynamic water pressure, which is more directly representative of thrust than a TPS. The pitot tube measurement would be fed to the control system's processor module whereupon the throttle would be adjusted accordingly until the desired thrust is attained. However, a pitot tube aft of the impeller may obstruct flow unacceptably and thus an alternative sensor (to replace the TPS) would be an engine speed sensor or an impeller speed sensor. All of the sensors, it should be noted, are adequate to provide feedback control of the propulsion unit's thrust. The use of a TPS is preferred because it is reliable, inexpensive and easy to mount to existing carburetors. Furthermore, since the throttle is the object that is being actually controlled, it makes sense to measure the actual throttle setting to provide a feedback control system that corrects the throttle setting based on the differential between the actual and the desired settings.

Figure 15:
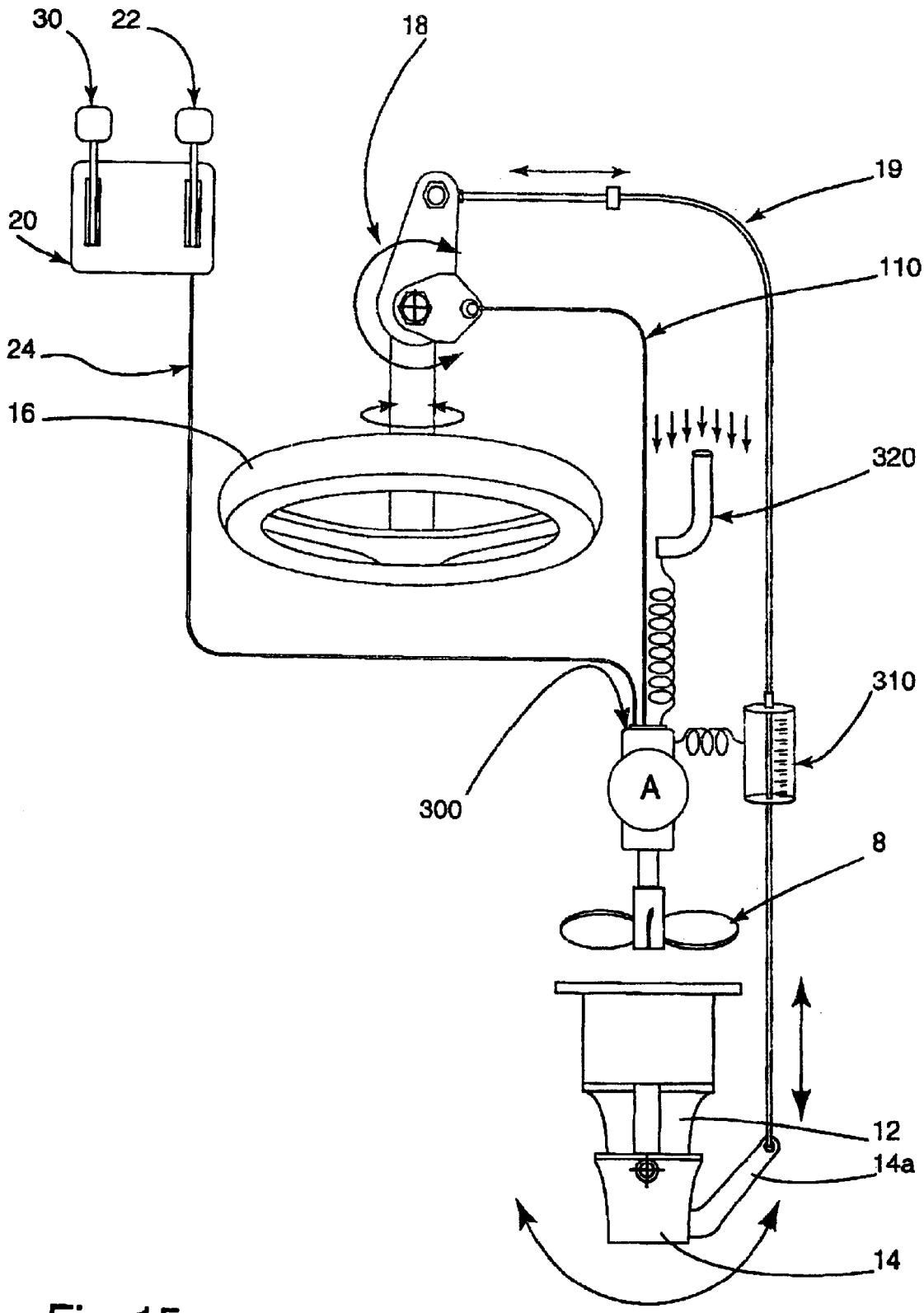
FIG. 15 is a schematic depicting a variant of the embodiment shown in FIG. 14.

In the variant illustrated in FIG. 15, there is no TPS (or equivalent sensor). The throttle control cable 24 is connected directly to the throttle, replacing the electrical wire 24*a* linking the manual throttle control and the control system module. With a direct mechanical connection, the throttle control cable 24 can open the throttle independently of the throttle actuator cable 110 (as previously described with regard to FIG. 3). Since the throttle actuator cable 110 and throttle control cable 24 can independently open the throttle, the actual throttle setting is determined by whichever device (the actuator cable or the control cable) opens the throttle the most. Whether the throttle is opened by the displacement of the throttle actuator depends on the current throttle setting. If the manual throttle lever is set to produce sufficient thrust for steering, the throttle actuator will have no effect on the throttle. Only if the manual throttle lever is set to produce insufficient thrust for steering will the throttle actuator open the throttle. The throttle actuator will thus ensure that the throttle is opened to a setting corresponding to the minimum thrust required for steering regardless of the position of the manual throttle lever.

A steer-angle sensor 310 and an airspeed-measuring pitot tube 320 convey electrical signals to the control module 300 which calculates the required thrust based on the inputs from the speed sensor and steering sensor. An output signal is generated (if additional steering thrust found to be necessary). A rev limiter receives the output signal. The rev limiter functions to limit the engine speed by cutting the sparks in the cylinder of the engine. Alternatively, a rev limiter can delay the sparking in the cylinder so as to produce a non-optimal power-stroke. In either event, the rev limiter reduces the engine speed and thus the thrust being produced by the propulsion unit. For the variant shown in FIG. 15, the throttle is calibrated to open to the maximum thrust that would be required for steering. If the manual throttle control is set to produce a thrust that is insufficient for steering and the steering wheel is turned beyond the predetermined angular threshold, the throttle actuator cable 110 opens the throttle to a maximum setting corresponding uniquely to the steer-angle (i.e., regardless of the watercraft's speed). When a lesser thrust is required (e.g., if the control module registers via the pitot tube 320 that the watercraft is travelling at a lesser speed), the control module activates the rev limiter. Irrespective of the opening of the throttle, the rev limiter is capable of limiting the RPM of the engine, thereby reducing the thrust generated by the propulsion unit.

The above description of preferred embodiments should not be interpreted in a limiting manner since other variations, modification and refinements are possible within the spirit and scope of the present invention. The scope of the invention is defined in the appended claims and their equivalents.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. A jet propulsion watercraft comprising:

(A) a hull;

(B) a propulsion unit, comprising:

an internal combustion engine within said hull;

a manual throttle control for controlling a throttle of said internal combustion engine;

a jet propulsion water pump driven by said internal combustion engine, said jet propulsion water pump having a body, a water inlet for admitting water into said body, a water outlet at the opposite end of said body, an impeller for circulating water longitudinally through said body;

(C) a manual steering control for steering said jet propulsion watercraft;

(D) a steering nozzle coupled to said body in registry with said water outlet, said steering nozzle capable of being pivoted for controlling the direction of the jet of water produced by said propulsion unit and thereby steering said jet propulsion watercraft; and (E) a throttle actuator responsive to said manual steering control for causing said propulsion unit to generate a propulsion force at least equal to the minimum propulsive force necessary to effectively steer said jet propulsion watercraft when said manual steering control is turned in either direction beyond a predetermined angular threshold, whereby to cause said jet propulsion watercraft to remain maneuverable independently of the manual throttle control setting.

2. A jet propulsion watercraft as defined in claim 1 wherein said throttle actuator is capable of controlling the speed of said engine.

3. A jet propulsion watercraft as defined in claim 2 wherein said throttle actuator is capable of controlling said throttle.

4. A jet propulsion watercraft as defined in claim 3 wherein said throttle actuator comprises a cable responsive to said manual steering control and connected to said throttle for opening and closing said throttle.

5. A jet propulsion watercraft as defined in claim 4 wherein said throttle actuator comprises a lost-motion mechanism whereby said throttle is actuated only when said manual steering control is turned beyond a predetermined angular threshold.

6. A jet propulsion watercraft as defined in claim 5 wherein said manual steering control is mounted to a steering assembly, said steering assembly having a bracket for retaining said cable.

7. A jet propulsion watercraft as defined in claim 6 wherein said steering assembly comprises mated gears for converting the rotation of said manual steering control into a rotation of said bracket.

8. A jet propulsion watercraft as defined in claim 7 further comprising a cable-receiving member fixed to said bracket, said cable-receiving member having a bore through which said cable can translate.

9. A jet propulsion watercraft as defined in claim 8 wherein said cable has an end-stopper of greater diameter than the diameter of said bore so that when said manual steering control is turned to the threshold, the end-stopper engages said cable-receiving member, whereby further rotation of the manual steering control causes said cable to be displaced, thereby opening said throttle.

10. A jet propulsion watercraft as defined in claim 9 wherein said cable-receiving member is mounted eccentrically with respect to a vertical pivot axis of said bracket whereby rotation in either direction results in displacement of the cable-receiving member.

11. A jet propulsion watercraft as defined in claim 10 wherein said watercraft is a single-engine personal watercraft.

12. A jet propulsion watercraft as defined in claim 10 wherein said watercraft is a twin-engine jet boat having two propulsion units and two steering nozzles coupled together for steering said jet propulsion watercraft.

13. A jet propulsion watercraft as defined in claim 12 wherein said throttle actuator has two cables.

14. A jet propulsion watercraft as defined in claim 13 wherein said throttle actuator has two cable-receiving members symmetrically fined to said bracket whereby rotation of said bracket in one direction causes only one cable to be actuated and whereby rotation of said bracket in the opposite direction causes only the other cable to be actuated, thereby ensuring that only one of said throttles is opened.

15. A jet propulsion watercraft as defined in claim 14 wherein turning of the manual steering control to the right actuates the throttle of the right propulsion unit and turning of the manual steering control to the left actuates the throttle of the left propulsion unit.

16. A jet propulsion watercraft as defined in claim 14 wherein turning of the manual steering control to the right actuates the throttle of the left propulsion unit and turning of the manual steering control to the left actuates the throttle of the right propulsion unit.

17. A watercraft comprising:

(A) a hull;

(B) a steerable propulsion unit driven by an internal combustion engine, said unit capable of generating thrust and capable of steering said watercraft by directing said thrust in a desired direction;

(C) a manual throttle control for controlling a throttle of said internal combustion engine;

(D) a manual steering control for steering said watercraft; and (E) a throttle actuator responsive to said manual steering control for causing said steerable propulsion unit to generate a propulsive force at least equal to the minimum propulsive force necessary to effectively steer said watercraft when said manual steering control is turned in either direction beyond a predetermined angular threshold, whereby to cause said watercraft to remain maneuverable independently of the manual throttle control setting.

18. A watercraft as defined in claim 17 wherein said throttle actuator is capable of controlling the speed of said engine.

19. A watercraft as defined in claim 18 wherein said throttle actuator is capable of controlling said throttle.

20. A watercraft as defined in claim 19 wherein said throttle actuator comprises a cable responsive to said manual steering control and connected to said throttle for opening and closing said throttle.

21. A watercraft as defined in claim 20 wherein said throttle actuator comprises a lost-motion mechanism whereby said throttle is actuated only when said manual steering control is turned beyond a predetermined angular threshold.

22. A watercraft as defined in claim 21 wherein said manual steering control is mounted to a steering assembly, said steering assembly having a bracket for retaining said cable.

23. A watercraft as defined in claim 22 wherein said steering assembly comprises mated gears for converting the rotation of said manual steering control into a rotation of said bracket.

24. A watercraft as defined in claim 23 further comprising a cable-receiving member fixed to said bracket, said cable-receiving member having a bore through which said cable can translate.

25. A watercraft as defined in claim 24 wherein said cable has an end-stopper of greater diameter than the diameter of said bore so that when said manual steering control is turned to the threshold, the end-stopper engages said cablereceiving member, whereby further rotation of the manual steering control causes said cable to be displaced, thereby opening said throttle.

26. A watercraft as defined in claim 25 wherein said cable-receiving member is mounted eccentrically with respect to a vertical pivot axis of said bracket whereby rotation in either direction results in displacement of the cable-receiving member.

27. A watercraft as defined in claim 26 wherein said watercraft has a single steerable propulsion unit.

28. A watercraft as defined in claim 26 wherein said watercraft has a pair of steerable propulsion units.

29. A watercraft as defined in claim 28 wherein said throttle actuator has two cables.

30. A watercraft as defined in claim 29 wherein said throttle actuator has two cable-receiving members symmetrically fixed to said bracket whereby rotation of said bracket in one direction causes only one cable to be actuated and whereby rotation of said bracket in the opposite direction causes only the other cable to be actuated, thereby ensuring that only one of said throttles is opened.

31. A watercraft as defined in claim 30 wherein turning of the manual steering control to the right actuates the throttle of the right propulsion unit and turning of the manual steering control to the left actuates the throttle of the left propulsion unit.

32. A watercraft as defined in claim 30 wherein turning of the manual steering control to the right actuates the throttle of the left propulsion unit and turning of the manual steering control to the left actuates the throttle of right propulsion unit.

33. A jet propulsion watercraft comprising:

(A) a hull;

(B) a propulsion unit, comprising:

an internal combustion engine within said hull, said engine having a throttle for controlling the speed of rotation of said engine;

a manual throttle control for controlling the throttle of said internal combustion engine;

a jet propulsion water pump driven by said internal combustion engine, said jet propulsion water pump having a body, a water inlet for admitting water into said body, a water outlet at the opposite end of said body, an impeller for circulating water longitudinally through said body;

(C) a manual steering control for steering said watercraft;

(D) a steering nozzle coupled to said manual steering control and positioned immediately rearwardly of said body in registry with said water outlet, said steering nozzle capable of being pivoted for controlling the direction of the jet of water produced by said propulsion unit and thereby steering said watercraft;

(E) a throttle actuator responsive to a signal for causing the propulsion unit to generate a propulsive force at least equal to the minimum propulsive force necessary to effectively steer said watercraft for a given speed when said manual steering control is turned in either direction beyond a predetermined angular threshold, whereby to cause said watercraft to remain maneuverable independently of the manual throttle control setting;

(F) a steer angle measuring device for generating a steer angle signal representative of the steer angle of said steering nozzle;

(G) a speed measuring device for generating a speed signal representative of the speed of the watercraft;

(H) a throttle actuator control circuit for generating an output signal for controlling said throttle actuator, said throttle actuator control circuit having:

a first input for receiving said steer angle signal;

a second input for receiving said speed signal; and an output signal generator for generating an output signal in response to signals received at said first and second inputs, said output signal being applied to said throttle actuator for controlling said throttle actuator.

34. A jet propulsion watercraft as defined in claim 33 wherein said throttle actuator is capable of controlling the speed of said engine.

35. A jet propulsion watercraft as defined in claim 34 wherein said throttle actuator is capable of controlling said throttle.

36. A jet propulsion watercraft as defined in claim 35 wherein said throttle actuator comprises a cable responsive to said manual steering control and connected to said throttle for opening and closing said throttle.

37. A jet propulsion watercraft as defined in claim 36 further comprising an RPM limiter controlled by said throttle actuator control circuit, said RPM limiter capable of controlling the spark plugs of said internal combustion engine so as to regulate said engine's speed.

38. A jet propulsion watercraft as defined in claim 37 wherein said RPM limiter temporarily interrupts current to the spark plugs whereby intermittent ignition limits the engine speed.

39. A jet propulsion watercraft as defined in claim 38 wherein said RPM limiter causes the spark plugs to arc non-optimally so as to diminish the engine's power stroke and thus to limit the RPM of the engine.

40. A jet propulsion watercraft as defined in claim 39 further comprising a throttle measuring device for generating a throttle signal representative of the position of the throttle, said throttle actuator control circuit further comprising a third input for receiving said throttle signal; said output signal generator generating an output signal in response to signals received at said first, second and third inputs; said output signal being applied to said throttle actuator for controlling said throttle actuator.

41. A jet propulsion watercraft as defined in claim 39 further comprising a throttle measuring device for generating a throttle signal representative of the position of the throttle, said throttle actuator control circuit further comprising a third input for receiving said throttle signal; said output signal generator generating an output signal in response to signals received at said first, second and third inputs; said output signal being applied to said throttle actuator for controlling said throttle actuator.

42. A watercraft comprising:

(A) a hull;

(B) a steerable propulsion unit driven by an internal combustion engine, said unit capable of generating thrust and capable of steering said watercraft by directing said thrust in a desired direction;

(C) a manual throttle control for controlling said internal combustion engine;

(D) a manual steering control for steering said watercraft;

(E) a throttle actuator responsive to a signal for causing the steerable propulsion unit to generate a propulsive force at least equal to the minimum propulsive force necessary to effectively steer said watercraft for a given speed when said manual steering control is turned in either direction beyond a predetermined angular threshold, whereby to cause said watercraft to remain maneuverable independently of the manual throttle control setting;

(F) a steer angle measuring device for generating a steer angle signal representative of the steer angle of said steerable propulsion unit;

(G) a speed measuring device for generating a speed signal representative of the speed of the watercraft;

(H) a throttle actuator control circuit for generating an output signal for controlling said throttle actuator; said throttle actuator control circuit having:

a first input for receiving said steer angle signal;

a second input for receiving said speed signal; and an output signal generator for generating an output signal in response to signals received at said first and second input; said output signal being applied to said throttle actuator for controlling said throttle actuator.

43. A watercraft as defined in claim 42 wherein said throttle actuator is capable of controlling the speed of said engine.

44. A watercraft as defined in claim 43 wherein said throttle actuator is capable of controlling said throttle.

45. A watercraft as defined in claim 44 wherein said throttle actuator comprises a cable responsive to said manual steering control and connected to said throttle for opening and closing said throttle.

46. A watercraft as defined in claim 45 further comprising an RPM limiter controlled by said control circuit, said RPM limiter capable of controlling the spark plugs of said internal combustion engine so as to regulate said engine's speed.

47. A watercraft as defined in claim 46 wherein said RPM limiter temporarily interrupts current to the spark plugs whereby intermittent ignition limits the engine speed.

48. A watercraft as defined in claim 46 wherein said RPM limiter causes the spark plugs to arc non-optimally so as to diminish the engine's power stroke and thus to limit the RPM of the engine.

49. A watercraft as defined in claim 47 further comprising a throttle measuring device for generating a throttle signal representative of the position of the throttle, said throttle actuator control circuit further comprising a third input for receiving said throttle signal; said output signal generator generating an output signal in response to signals received at said first, second and third inputs; said output signal being applied to said throttle actuator for controlling said throttle actuator.

50. A watercraft as defined in claim 48 further comprising a throttle measuring device for generating a throttle signal representative of the position of the throttle, said throttle actuator control circuit further comprising a third input for receiving said throttle signal; said output signal generator generating an output signal in response to signals received at said first, second and third inputs; said output signal being applied to said throttle actuator for controlling said throttle actuator.

51. A watercraft, comprising:

a hull;

a steering assembly supported by the hull;

an engine mounted within the hull;

a manually actuated throttle control operatively connected to the engine for manually changing engine speed;

a jet propulsion assembly supported by the hull having an inlet that draws in water and an outlet which expels water, wherein the jet propulsion assembly is operatively connected to the engine so that the engine drives the jet propulsion assembly to generate thrust and expel a pressurized stream of water that propels the watercraft;

a steering nozzle disposed at the outlet of the jet propulsion assembly and operatively connected to the steering assembly, wherein the steering assembly transmits steering signals to the steering nozzle to direct the pressurized stream of water in a desired direction to steer the watercraft; and an actuator operatively connected to the engine and the steering assembly that controls engine speed so that a minimum thrust is generated by the jet propulsion assembly when the steering assembly is turned beyond an angular threshold to effectively steer the watercraft.

52. The watercraft of claim 51, wherein the actuator controls the engine speed so that the jet propulsion unit generates at least a minimum thrust when the steering assembly is turned beyond on angular threshold and when the manually actuated throttle control is at idle.

53. The watercraft of claim 51, wherein the watercraft is a personal watercraft.

54. The watercraft of claim 53, wherein in the personal watercraft has a straddle seat.

55. The watercraft of claim 51, wherein the jet propulsion assembly includes two jet propulsion devices.

56. The watercraft of claim 51, wherein the watercraft is a sport boat.

57. The watercraft of claim 51, wherein the engine has a carburetor and a throttle, wherein the actuator controls the throttle to control engine speed.

58. The watercraft of claim 51, wherein the engine is fuel injected.

59. The watercraft of claim 51, wherein the actuator controls the fuel and air mixture in the engine.

60. The watercraft of claim 51, wherein the actuator comprises an electronic control system.

61. The watercraft of claim 60, wherein the electronic control system comprises a processor, a steering angle sensor and a speed sensor.

62. The watercraft of claim 61, wherein the electronic control system receives input from the steering angle sensor and the speed sensor and generates an output that instructs the engine to increase speed when the steering angle sensor input indicates steering beyond a threshold.

63. A personal watercraft comprising:

a hull;

a deck supported by the hull;

a straddle seat mounted on the deck;

a helm mounted on the deck, the helm including a manual throttle control and a steering element;

an engine supported in the hull;

a jet propulsion assembly supported by the hull and operatively connected to the engine to generate a pressurized stream of water that propels the watercraft;

a steering nozzle connected to the jet propulsion unit that selectively directs the pressurized stream of water to effect steering; and an engine speed controller operatively connected to the engine and the steering element to increase engine speed upon a steering signal generated by turning the steering element from a first position to a second position.

64. The personal watercraft of claim 63, wherein the engine speed controller increases engine speed upon the steering signal when the manual throttle control is at idle.

65. The personal watercraft of claim 63, wherein the engine is an internal combustion engine with a throttle.

66. The personal watercraft of claim 65, wherein the engine speed controller is an actuator comprising a cable coupled to the throttle to open the throttle based on the steering signal.

67. The personal watercraft of claim 63, wherein the engine is an internal combustion engine with a fuel injector.

68. The personal watercraft of claim 67, wherein the engine speed controller comprises an electronic control system.

69. The personal watercraft of claim 68, wherein the electronic control system comprises a steering sensor, a speed sensor, and processor.

70. The personal watercraft of claim 69, wherein the electronic control system generates an increase engine speed signal based on signals from the steering sensor and the speed sensor.

71. The personal watercraft of claim 63, wherein the engine speed controller comprises an electronic control system.

72. The personal watercraft of claim 71, wherein the electronic control system comprises a steering sensor, a speed sensor, and a processor, and wherein the electronic control system generates an increase engine speed signal based on signals from the steering sensor and the speed sensor.

73. The personal watercraft of claim 63, wherein the engine speed controller generates an increase engine speed signal when the engine speed falls below a threshold.

* * * * *

Disclaimer

6,428,371 B1 — Camille Michel, Ste-Foy, Canada; Alain Rheault, Longueuil, CA. WATERCRAFT WITH STEER RESPONSIVE ENGINE SPEED CONTROLLER. Patent dated August 6, 2002. Disclaimer filed October 28, 2005, by the assignee, BRP US INC.

The term of this patent shall not extend beyond the expiration date of Patent Nos. 6,336,833 and 6,405,669.

*(Official Gazette, January 10, 2006)*